US008492308B2

(12) United States Patent
Kurihara et al.

(10) Patent No.: US 8,492,308 B2
(45) Date of Patent: Jul. 23, 2013

(54) THERMOSENSITIVE RECORDING MEDIUM

(75) Inventors: Tatsuyuki Kurihara, Tokyo (JP); Tatsuo Nagai, Tokyo (JP); Yoshimi Midorikawa, Tokyo (JP); Akihito Ogino, Tokyo (JP); Mamoru Suga, Tokyo (JP); Yoshimune Aosaki, Chikujo-gun (JP)

(73) Assignees: Nippon Paper Industries Co., Ltd., Tokyo (JP); API Corporation, Toyko (JP)

( * ) Notice: Subject to any disclaimer, the term of this patent is extended or adjusted under 35 U.S.C. 154(b) by 461 days.

(21) Appl. No.: 12/674,296

(22) PCT Filed: Aug. 21, 2008

(86) PCT No.: PCT/JP2008/064904
§ 371 (c)(1),
(2), (4) Date: Feb. 19, 2010

(87) PCT Pub. No.: WO2009/025316
PCT Pub. Date: Feb. 26, 2009

(65) Prior Publication Data

US 2011/0130281 A1 Jun. 2, 2011

(30) Foreign Application Priority Data

| | | |
|---|---|---|
| Aug. 21, 2007 | (JP) | 2007-214392 |
| Sep. 19, 2007 | (JP) | 2007-241896 |
| Sep. 25, 2007 | (JP) | 2007-246765 |
| Oct. 2, 2007 | (JP) | 2007-258371 |
| Oct. 3, 2007 | (JP) | 2007-259378 |

(51) Int. Cl.
*B41M 5/333* (2006.01)

(52) U.S. Cl.
USPC ..... 503/216; 503/209; 503/225

(58) Field of Classification Search
None
See application file for complete search history.

(56) References Cited

U.S. PATENT DOCUMENTS

| | | | |
|---|---|---|---|
| 4,032,690 | A | 6/1977 | Kohmura et al. |
| 4,243,716 | A | 1/1981 | Kosaka et al. |
| 4,265,978 | A | 5/1981 | Morishita et al. |
| 6,037,308 | A | 3/2000 | Sato et al. |
| 6,656,880 | B2 | 12/2003 | Aono |
| 6,680,281 | B2 | 1/2004 | Tajiri et al. |
| 7,618,922 | B2 | 11/2009 | Ogino et al. |
| 8,129,307 | B2 | 3/2012 | Makihara et al. |
| 8,247,347 | B2 | 8/2012 | Takagi et al. |
| 8,283,284 | B2 | 10/2012 | Hirai et al. |
| 2003/0045426 | A1 | 3/2003 | Ito |
| 2004/0198603 | A1 | 10/2004 | Kawakami et al. |
| 2004/0241598 | A1 | 12/2004 | Suga et al. |
| 2005/0118526 | A1 | 6/2005 | Suga et al. |
| 2006/0264326 | A1 | 11/2006 | Fisher et al. |
| 2008/0139385 | A1 | 6/2008 | Ogino et al. |
| 2008/0214786 | A1 | 9/2008 | Oyama |
| 2010/0062935 | A1 | 3/2010 | Takagi et al. |
| 2010/0099557 | A1 | 4/2010 | Makihara et al. |
| 2010/0248959 | A1 | 9/2010 | Kato et al. |
| 2011/0105319 | A1 | 5/2011 | Hirai et al. |
| 2011/0269622 | A1 | 11/2011 | Ohse et al. |
| 2012/0038737 | A1 | 2/2012 | Hirai et al. |

FOREIGN PATENT DOCUMENTS

| | | |
|---|---|---|
| EP | 0 465 665 | 1/1992 |
| EP | 0 764 635 | 3/1997 |
| EP | 0 779 539 | 6/1997 |
| EP | 1 116 713 | 7/2001 |
| EP | 1 199 185 | 4/2002 |
| EP | 1 367 437 | 12/2003 |
| EP | 1 437 231 | 7/2004 |
| EP | 1 747 898 | 1/2007 |
| EP | 1 808 304 | 7/2007 |
| EP | 2 072 274 | 6/2009 |
| EP | 2 145 771 | 1/2010 |
| GB | 2 187 297 | 9/1987 |
| JP | 53-091995 | 8/1978 |
| JP | 54-128349 | 10/1979 |
| JP | 57-165290 | 10/1982 |
| JP | 60-179290 | 9/1985 |
| JP | 61-181680 | 8/1986 |
| JP | 61-291179 | 12/1986 |
| JP | 62-270383 | 11/1987 |
| JP | 1-196389 | 8/1989 |

(Continued)

OTHER PUBLICATIONS

European Search Report corresponding to European Patent Application No. 09725687.9-2304 dated Feb. 24, 2012.

(Continued)

*Primary Examiner* — Bruce H Hess
(74) *Attorney, Agent, or Firm* — Jenkins, Wilson, Taylor & Hunt, P.A.

(57) ABSTRACT

The present invention provides a thermosensitive recording medium with excellent color developing sensitivity, moist heat resistance and plasticizer resistance, as well as excellent heat resistance, background coloring, light resistance and the like in the printed image.

A diphenyl sulfone derivative containing a hydroxyl group on one end and an alkoxy group on the other end has a higher melting point than the one containing hydroxyl groups on both ends. As a result, the thermosensitive recording medium obtained using the diphenyl sulfone derivative as the color developing agent in the thermosensitive color developing layer has excellent heat resistance. However the color developing sensitivity of the thermosensitive recording medium generally declines simultaneously, when a color developing agent with a high melting point is ordinarily used. The thermosensitive recording medium of the present invention that uses a combination of the diphenyl sulfone derivative and a specific phenol derivative in the thermosensitive color developing layer has a good color developing sensitivity and an improved balance among the properties such as moist heat resistance, plasticizer resistance and the like.

11 Claims, No Drawings

FOREIGN PATENT DOCUMENTS

| | | |
|---|---|---|
| JP | 2-55188 | 2/1990 |
| JP | 03 047790 | 2/1991 |
| JP | 3-190786 | 8/1991 |
| JP | 3-205181 | 9/1991 |
| JP | 3-219993 | 9/1991 |
| JP | H04-164687 | 6/1992 |
| JP | 05-139033 | 6/1993 |
| JP | 5-162443 | 6/1993 |
| JP | 5-221115 | 8/1993 |
| JP | H06-155916 | 6/1994 |
| JP | 6-234275 | 8/1994 |
| JP | 6-262853 | 9/1994 |
| JP | H06-270547 | 9/1994 |
| JP | H06-286308 | 10/1994 |
| JP | 6-340171 | 12/1994 |
| JP | 7149713 | 6/1995 |
| JP | 07-179041 | 7/1995 |
| JP | H07-266711 | 10/1995 |
| JP | 07-314896 | 12/1995 |
| JP | H08-059603 | 3/1996 |
| JP | 08-207443 | 8/1996 |
| JP | 08-324123 | 12/1996 |
| JP | H08-333329 | 12/1996 |
| JP | H09-142018 | 6/1997 |
| JP | H09-207435 | 8/1997 |
| JP | H09-263047 | 10/1997 |
| JP | H10-250232 | 9/1998 |
| JP | H10-258577 | 9/1998 |
| JP | 10-272839 | 10/1998 |
| JP | H10-297089 | 11/1998 |
| JP | H10-297090 | 11/1998 |
| JP | 10-324062 | 12/1998 |
| JP | 10-324064 | 12/1998 |
| JP | 11-314454 | 11/1999 |
| JP | 2000-143611 | 5/2000 |
| JP | 2000-168242 | 6/2000 |
| JP | 2000-177243 | 6/2000 |
| JP | 3058758 | 7/2000 |
| JP | 2000-289333 | 10/2000 |
| JP | 2001-287459 | 10/2001 |
| JP | 2001-322358 | 11/2001 |
| JP | 2001-323095 | 11/2001 |
| JP | 2002-011954 | 1/2002 |
| JP | 2002-019300 | 1/2002 |
| JP | 2002-103789 | 4/2002 |
| JP | 2002-240430 | 8/2002 |
| JP | 2002-264538 | 9/2002 |
| JP | 2002-293023 | 10/2002 |
| JP | 2002-301873 | 10/2002 |
| JP | 2002-341770 | 11/2002 |
| JP | 2003-019861 | 1/2003 |
| JP | 2003-154760 | 5/2003 |
| JP | 2003-212841 | 7/2003 |
| JP | 3439560 | 8/2003 |
| JP | 2003-313795 | 11/2003 |
| JP | 2004-202913 | 7/2004 |
| JP | 2005-001281 | 1/2005 |
| JP | 2005-041013 | 2/2005 |
| JP | 2005-134578 | 5/2005 |
| JP | 2005-154996 | 6/2005 |
| JP | 2005-199554 | 7/2005 |
| JP | 2005-220480 | 8/2005 |
| JP | 2005-262549 | 9/2005 |
| JP | 3716736 | 11/2005 |
| JP | 2006-069032 | 3/2006 |
| JP | 3750786 | 3/2006 |
| JP | 2006-095852 | 4/2006 |
| JP | 2006-168319 | 6/2006 |
| JP | 3790648 | 6/2006 |
| JP | 2006-175835 | 7/2006 |
| JP | 2006-264255 | 10/2006 |
| JP | 2006-281472 | 10/2006 |
| JP | 2007-196616 | 8/2007 |
| JP | 2007-231485 | 9/2007 |
| JP | 3971453 | 9/2007 |
| JP | 2008-012879 | 1/2008 |
| JP | 2008-018619 | 1/2008 |
| JP | 2008-044226 | 2/2008 |
| JP | 2008-044227 | 2/2008 |
| JP | 2006-205561 | 8/2008 |
| JP | 2008-105222 | 8/2008 |
| JP | 2008-194918 | 8/2008 |
| JP | 2008-248408 | 10/2008 |
| JP | 2008-248459 | 10/2008 |
| JP | 2009-012247 | 1/2009 |
| WO | WO93/06074 | 4/1993 |
| WO | WO95/33714 | 12/1995 |
| WO | WO97/16420 | 5/1997 |
| WO | WO00/14058 | 3/2000 |
| WO | WO01/25193 | 4/2001 |
| WO | WO02/081229 | 10/2002 |
| WO | WO02/098674 | 12/2002 |
| WO | WO03/029017 | 4/2003 |
| WO | WO2004/002748 | 1/2004 |
| WO | WO2005/087503 | 9/2005 |
| WO | WO2005/087504 | 9/2005 |
| WO | WO2005/102725 | 11/2005 |
| WO | WO2006/075467 | 7/2006 |
| WO | WO2007/049621 | 5/2007 |
| WO | WO2008/099658 | 8/2008 |
| WO | WO2008/126635 | 10/2008 |
| WO | WO2008/139948 | 11/2008 |
| WO | WO2009/025316 | 2/2009 |
| WO | WO2009/028118 | 3/2009 |
| WO | WO2009/119813 | 10/2009 |
| WO | WO2010/110209 | 9/2010 |
| WO | WO2010/140662 | 12/2010 |
| WO | WO2011/114780 | 9/2011 |

OTHER PUBLICATIONS

Extended European Search Report corresponding to European Patent Application No. 08827733.0-2304 dated Jan. 27, 2012.

International Search Report corresponding to International Patent Application No. PCT/JP2007/074385 dated Feb. 14, 2008.

International Search Report corresponding to International Patent Application No. PCT/JP2008/051100 dated Apr. 15, 2008.

International Search Report corresponding to International Patent Application No. PCT/JP2008/054719 dated Sep. 22, 2008.

International Search Report corresponding to International Patent Application No. PCT/JP2008/058329 dated Jun. 9, 2008.

International Search Report corresponding to International Patent Application No. PCT/JP2008/064904 dated Oct. 7, 2008.

International Search Report corresponding to International Patent Application No. PCT/JP2009/056306 dated May 19, 2009.

International Search Report corresponding to International Patent Application No. PCT/JP2010/054818 dated Apr. 13, 2010.

International Search Report corresponding to International Patent Application No. PCT/JP2010/059462 dated Aug. 17, 2010.

Isogai et al., "Effects of Carboxyl Groups in Pulp on Retention of Alkylketene Dimer," Journal of Pulp and Paper Science. vol. 23, No. 5 pp. J215-J219 (1997).

Japanese Industrial Standard (JIS) P-8148. Paper, board and pulps—Measurement of diffuse blue reflectance factor (ISO brightness). Japanese Standards Association (2001).

Notice of Allowance corresponding to U.S. Appl. No. 12/520,514 dated Oct. 26, 2011.

Notice of Allowance corresponding to U.S. Appl. No. 12/593,116 dated May 15, 2012.

Notice of Allowance corresponding to U.S. Appl. No. 12/599,617 dated Apr. 16, 2012.

Notification Concerning Transmittal of International Preliminary Report on Patentability (Chapter I of the Patent Cooperation Treaty) corresponding to International Patent Application No. PCT/JP2009/056306 dated Oct. 7, 2010.

Notification Concerning Transmittal of International Preliminary Report on Patentability (Chapter I of the Patent Cooperation Treaty) corresponding to International Patent Application No. PCT/JP2010/054818 dated Sep. 24, 2011.

Notification of Transmittal of Translation of the International Preliminary Report on Patentability (Chapter I or Chapter II of the Patent Cooperation Treaty) corresponding to International Patent Application No. PCT/JP2007/074385 dated Mar. 18, 2010.

Notification of Transmittal of Translation of the International Preliminary Report on Patentability (Chapter I or Chapter II of the Patent Cooperation Treaty) corresponding to International Application No. PCT/JP2008/051100 dated Aug. 27, 2009.
Notification of Transmittal of Translation of the International Preliminary Report on Patentability (Chapter I or Chapter II of the Patent Cooperation Treaty) corresponding to International Patent Application No. PCT/JP2008/054719 dated Oct. 29, 2009.
Notification of Transmittal of Translation of the International Preliminary Report on Patentability (Chapter I or Chapter II of the Patent Cooperation Treaty) corresponding to International Patent Application No. PCT/JP2008/058329 dated Jan. 21, 2010.
Notification of Transmittal of Translation of the International Preliminary Report on Patentability (Chapter I or Chapter II of the Patent Cooperation Treaty) corresponding to International Patent Application No. PCT/JP2008/064904 dated Mar. 18, 2010.
Notification of Transmittal of Translation of the International Preliminary Report on Patentability (Chapter I or Chapter II of the Patent Cooperation Treaty) corresponding to International Patent Application No. PCT/JP2009/056306 dated Nov. 18, 2010.
Notification of Transmittal of Translation of the International Preliminary Report on Patentability (Chapter I or Chapter II of the Patent Cooperation Treaty) corresponding to International Patent Application No. PCT/JP2010/054818 dated Jan. 12, 2012.
Notification of Transmittal of Translation of the International Preliminary Report on Patentability (Chapter I or Chapter II of the Patent Cooperation Treaty) corresponding to International Patent Application No. PCT/JP2010/059462 dated Dec. 15, 2011.
Official Action corresponding to U.S. Appl. No. 12/520,514 dated Mar. 10, 2010.
Official Action corresponding to U.S. Appl. No. 12/520,514 dated Oct. 27, 2010.
Official Action corresponding to U.S. Appl. No. 12/593,116 dated Feb. 1, 2012.
Supplementary European Search Report corresponding to European Patent Application No. 08703912.9-1251/2112001 dated Jan. 22, 2010.
Supplementary European Search Report corresponding to European Patent Application No. 08722115.6-1251/2130681 dated Mar. 5, 2010.
Extended European Search Report corresponding to European Patent Application No. 10756006.2-2304 dated Apr. 11, 2012.
International Search Report corresponding to International Patent Application No. PCT/JP2011/051714 dated Apr. 5, 2011.
Notice of Allowance corresponding to U.S. Appl. No. 12/599,617 dated Jun. 27, 2012.
Notice of Opposition corresponding to European Patent Application No. 08 752 259.5-1251/2145771 dated Jun. 14, 2012.
Notification of Transmittal of Translation of the International Preliminary Report on Patentability (Chapter I or Chapter II of the Patent Cooperation Treaty) corresponding to International Patent Application No. PCT/JP2011/051714 dated Nov. 8, 2012.
Supplemental Notice of Allowability corresponding to U.S. Appl. No. 12/599,617 dated Aug. 13, 2012.
Translation, "Explanation for filing a request for early examination," filed in the corresponding JP application (2007-282831) on Feb. 10, 2009.
Translation, "Opinion," filed in the corresponding JP application (2007-282831) on Mar. 24, 2009 in response to an office action of Mar. 9, 2009.
Translation, "Test Report," filed in the corresponding JP application (2007-282831) on Feb. 10, 2009.

THERMOSENSITIVE RECORDING MEDIUM

FIELD OF THE INVENTION

The present invention relates to a thermosensitive recording medium that utilizes a color formation reaction between an electron donating leuco dye and an electron accepting color developing agent and more particularly to a thermosensitive recording medium having excellent color developing sensitivity, moist heat resistance and plasticizer resistance.

BACKGROUND OF THE INVENTION

A thermosensitive recording medium containing a thermosensitive color developing layer, the major component of which is an electron accepting color developing agent (henceforth referred to as "color developing agent") that develops color when heated with a colorless or pale colored electron donating leuco dye (henceforth referred to as "dye"), is widely used. A thermal printer and the like in which a thermal head is contained is used to record on the thermosensitive recording medium. This recording method has many feature such as low maintenance, low-cost, compact size, clear color development, etc. as compared with other recording methods. Therefore, it is used extensively in facsimile machines, computer printers, automatic ticket vending machines, measurement recorders, handy outdoor terminals and the like. The thermosensitive recording medium is used not only as the output paper in the various devices mentioned above but is also becoming popular for use in applications such as vouchers and the like where excellent durability is required.

When a thermosensitive recording medium is used for various tickets, receipts, labels, bank ATM print outs, gas and electrical meter read outs and vouchers such as horse racing tickets and the like, the medium needs to have plasticizer resistance and oil resistance, to avoid the problem of printed letter readability when the medium is stored for an extended period of time in contact with a film or synthetic leather, and light resistance and heat resistance to prevent fading when the medium is exposed to sunlight for an extended period of time.

For these reasons, a thermosensitive recording medium prepared by using a diphenyl sulfone derivative as the color developing agent (References 1 and 2), a thermosensitive recording medium prepared with a phenolic condensation compound (Reference 3), a thermosensitive recording medium prepared with a phenolic compound (Reference 4) and also a thermosensitive recording medium in which other color developing agents are combined with these agents (References 5-8) and the like have been disclosed.

Reference 1: Japanese Patent Application Public Disclosure No. 2003-212841
Reference 2: Japanese Patent Application Public Disclosure No. H08-333329
Reference 3: International Publication WO 2002/098674
Reference 4: International Publication WO 2001/25193
Reference 5: International Publication WO 2005/087503
Reference 6: International Publication WO 2005/087504
Reference 7: Japanese Patent Application Public Disclosure No. H10-297089
Reference 8: Japanese Patent Application Public Disclosure No. H10-297090

Problems to be Solved by the Invention

Thermosensitive recording media have been more frequently used in applications such as vouchers and the like recently, and additional image durability, particularly improved quality that allows bar codes to be read over time, is needed. The prior art described above provides adequate bar code readability immediately after printing when a specific color developing agent and a stabilizer are used in combination, a specific stabilizer and a sensitizer are used in combination, a specific color developing agent is used and the like. However, the bar code readability becomes inadequate over time, and problems are encountered with color developing sensitivity, moist heat resistance, plasticizer resistance and the like.

Therefore, the objective of the present invention is to present a thermosensitive recording medium with excellent color developing sensitivity, moist heat resistance and plasticizer resistance that also provides an image section with excellent heat resistance, background coloring, light resistance and the like.

Means to Solve the Problems

The diphenyl sulfone derivatives previously utilized as a color developing agent or an image stabilizer in a thermosensitive color developing layer of a thermosensitive recording medium were mainly the derivatives containing hydroxyl groups in both ends. (See References 2-4 etc.) Then the inventors developed a thermosensitive recording medium using a diphenyl sulfone derivative by leaving one of the hydroxyl groups and replacing the other hydroxyl group with an alkoxy group in the diphenyl sulfone derivative (Reference 1). The developed diphenyl sulfone derivative has a higher melting point than the derivative with two hydroxyl groups at both ends and, as a result, the heat resistance of the thermosensitive recording medium using the diphenyl sulfone derivative was also high. However, the color developing sensitivity generally declines when a color developing agent with a high melting point is used. Then the inventors discovered as a result of a study that a thermosensitive recording medium with well balanced performance among color developing sensitivity in the image section, moist heat resistance, plasticizer resistance and the like could be obtained through the combined use of a diphenyl sulfone derivative (Reference 1) in which one end contains a hydroxyl group and the other end contains an alkoxy group and a phenol derivative with a specific structure. The present invention was completed based on that discovery.

That is, the present invention is:

(1) A thermosensitive recording medium having a thermosensitive color developing layer comprising a colorless or pale colored electron donating leuco dye and an electron accepting color developing agent on a substrate, wherein the thermosensitive color developing layer contains, as electron accepting color developing agent(s), (a) a phenol derivative represented by the chemical formula 1:

[chemical formula 1]

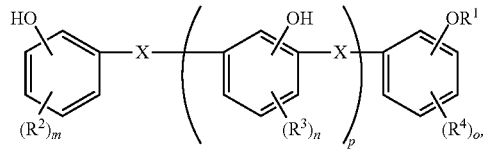

wherein $R^1$ represents a hydrogen atom or a linear or branched, saturated or unsaturated hydrocarbon containing 1 to 4 carbon atoms, $R^2$-$R^4$ independently represent alkyl groups containing 1 to 5 carbon atoms, alkenyl groups containing 1 to 5 carbon atoms, alkoxy groups containing 1 to 5 carbon atoms, aryl groups, aralkyl groups, halogen atoms, hydroxyl groups, cyano groups or nitro groups, X represents —$SO_2$—, —$C(R^5)_2$—, wherein $R^5$ independently represents hydrogen atoms, alkyl groups or aryl groups, or —$NHCOCH_2S$—, m, n and o each represents an integer of 0 to 3, p represents an integer of 0 to 3, and (b) a diphenyl sulfone derivative represented by the chemical formula 2 shown below

[chemical formula 2]

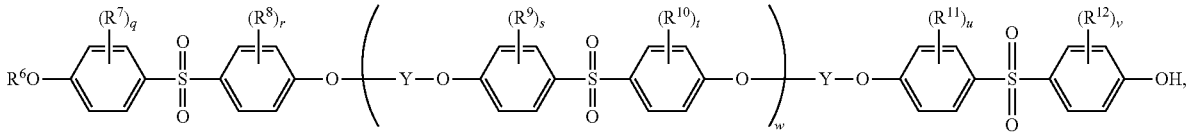

wherein $R^6$ represents a linear or branched, saturated or unsaturated hydrocarbon containing 1 to 12 carbon atoms, $R^7$-$R^{12}$ independently represent halogen atoms, or alkyl or alkenyl groups containing 1 to 12 carbon atoms, q, r, s, t, u and v each represent integers of 0 to 4, w represents an integer of 0 to 5, Y independently represents a linear or branched, saturated or unsaturated hydrocarbon groups containing 1 to 12 carbon atoms that may contain ether linkages.

In addition, the present invention is:

(2) The thermosensitive recording medium of (1) wherein the phenol derivative is a mixture of condensation products wherein the condensation products contains 40% to 99% of a two ring condensation product where $R^1$ is a hydrogen atom and p is 0 and the remainder of the condensation products are multi ring condensation products where $R^1$ is a hydrogen atom and p is at least 1, (3) The thermosensitive recording medium described in (1) wherein the phenol derivative is the compound with p is 0 in the chemical formula 1, (4) The thermosensitive recording medium described in any one of (1) to (3) wherein the ratio for the phenol derivative and the diphenyl sulfone derivative in the thermosensitive color developing layer (phenol derivative: diphenyl sulfone derivative (weight ratio)) is from 95:5 to 55:45, or (5) The thermosensitive recording medium described in any one of (1) to (4) wherein the thermosensitive color developing layer contains as the sensitizer 1,2-di-(3-methylphenoxy) ethane, bis-para-methylbenzyl oxalate or benzyl oxynaphthalene or a combination thereof.

Advantages of the Invention

The thermosensitive recording medium of the present invention has a well balanced performance among color developing sensitivity in the image section, moist heat resistance, plasticizer resistance and the like. The co-presence of a phenol derivative represented by chemical formula 1 and a diphenyl sulfone derivative represented by chemical formula 2 in the thermosensitive color developing layer is presumed to support the well balanced performance by increasing the stability of the electron transfer complex that is the reaction product of a color developing agent and a basic dye.

DETAILED DESCRIPTION OF THE INVENTION

The present invention is described in further detail below.

A thermosensitive recording medium of the present invention is prepared by forming a thermosensitive color developing layer on a substrate. And the thermosensitive color developing layer contains phenol derivative(s) represented by chemical formula 1 and a diphenyl sulfone derivative represented by chemical formula 2 as the color developing agents.

The phenol derivative of the present invention is represented by the chemical formula 1 shown below.

[chemical formula 1]

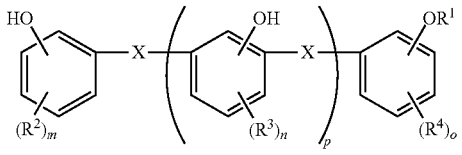

wherein, $R^1$ represents a hydrogen atom or a linear or branched, saturated or unsaturated hydrocarbon containing 1 to 4 carbon atoms. The saturated hydrocarbon group is, for example, a methyl group, ethyl group, n-propyl group, isopropyl group, n-butyl group, t-butyl group, iso-amyl group, or the like. The unsaturated hydrocarbon group is, for example, ethylene, 1-n-propenyl, 2-n-propenyl, isopropenyl, 1-n-butene, 2-n-butene, 3-n-butene groups or the like.

$R^2$-$R^4$ are independently alkyl groups containing 1 to 5 carbon atoms, alkenyl groups containing 1 to 5 carbon atoms, alkoxy groups containing 1 to 5 carbon atoms, aryl groups, aralkyl groups, halogen atoms, hydroxyl groups, cyano groups or nitro groups, preferably alkyl groups containing 1 to 5 carbon atoms or alkenyl groups containing 1 to 5 carbon atoms. The halogen atom is, for example, chlorine atom, bromine atom or fluorine atom, preferably chlorine atom. The alkyl group containing 1 to 5 carbon atoms is preferably an alkyl group containing 1 to 4 carbon atoms and is, for example, methyl, ethyl, propyl, isopropyl, t-butyl, and t-amyl groups or the like, preferably methyl, isopropyl or t-butyl. The alkoxy group containing 1 to 5 carbon atoms is preferably an alkoxy group containing 1 to 4 carbon atoms and is, for example, methoxy, ethoxy, propoxy, isopropoxy, butoxy, and t-butoxy groups or the like, preferably methoxy group. The aryl group is, for example, phenyl, tolyl, or naphthyl group or the like, preferably phenyl group. In addition, the aralkyl group is, for example, cumyl group or o-methylbenzyl group.

m, n and o are each independently an integer of 0 to 3, preferably 0 or 1. m, n and o are preferably the same.

X represents —$SO_2$—, —$C(R^5)_2$— or —$NHCOCH_2S$—, wherein $R^5$ independently represents hydrogen atoms, alkyl groups or aryl groups. All X are preferably the same in one molecule. The alkyl group represented by $R^5$ is preferably an alkyl group containing 1 to 3 carbon atoms, more preferably methyl group. The aryl group is preferably a phenyl group.

p represents an integer of 0 to 3.

The phenol derivative of the present invention preferably contains one hydroxyl group or an alkoxy group and zero or one hydroxyl group with two hydrogen atoms in the ortho positions on each of the benzene rings that constitute the phenol derivative, and preferably contains zero or one substituent ($R^2$-$R^4$) on each of the benzene rings. The hydroxyl group and the alkoxy group are located in para or ortho position to X. In addition, when the hydroxyl group and the alkoxy groups are located in para position to X, the substituents ($R^2$-$R^4$) are preferably located in ortho position to them. When the hydroxyl group and the alkoxy groups are located in ortho position to X, the substituents ($R^2$-$R^4$) are preferably located in para position to them.

That is, in a preferred phenol derivative of the present invention, shown by the formula below,

[chemical formula 3]

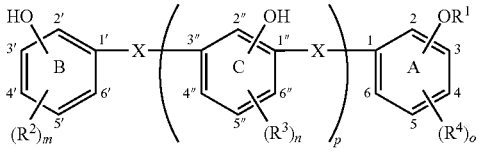

$OR^1$ is positioned in positions 2 or 4 in the A ring. When $OR^1$ is located in position 2, $R^4$ is positioned in 5, and when $OR^1$ is positioned in 4, $R^4$ is positioned in position 3. In the B ring, OH is located in either position 2' or 4'. When OH is located at position 2', $R^2$ is located in position 5', and when OH is positioned in position 4', $R^2$ is located in position 3'. In the C ring, OH is located in position 2" and $R^3$ is located in position 5".

The examples of preferred phenol derivatives of the present invention are shown in 1) to 6) of chemical formula 4 below. In the formulas, $R^{13}$ represents $R^1$ with the exception of hydrogen atom, and m and o each represents 0 or 1. Other symbols are the same as those described above.

[chemical formula 4]

1)

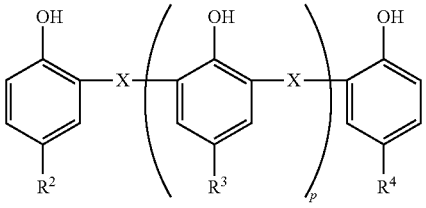

2)

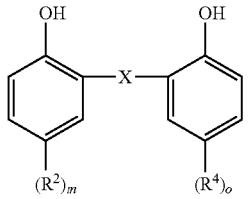

3)

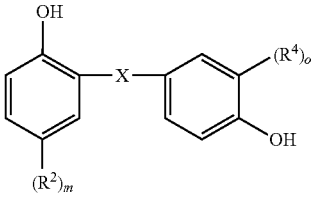

-continued

4)

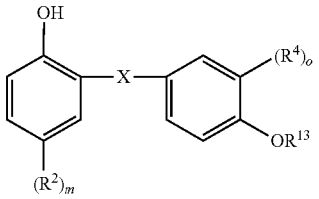

5)

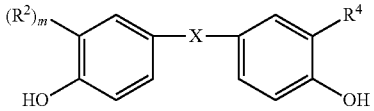

6)

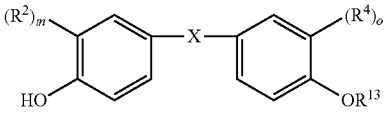

The particularly preferred phenol derivatives is (1) the condensation products represented by chemical formula 1 wherein $R^1$ is a hydrogen atom, which is, for example, 1) of chemical formula 4, and (2) the compound wherein p is 0, which is, for example, 2) to 6) of chemical formula 4.

These phenol derivatives preferably have melting points of 200° C. or lower. When the melting point exceeds 200° C., the thermosensitive recording medium derived may not have sufficient color developing sensitivity.

The specific examples of the two ring condensation product of the phenol derivatives (1), which is a condensation products with p=0 in chemical formula 1, may include, for example, 2,2'-methylene bisphenol, 2,2'-methylene bis(4-chlorophenol), 2,2'-methylene bis(5-chlorophenol), 2,2'-methylene bis(4-hydroxyphenol), 2,2'-methylene bis(5-hydroxyphenol), 2,2'-methylene bis(4-methylphenol), 2,2'-methylene bis(5-methylphenol), 2,2'-methylene bis(4-ethylphenol), 2,2'-methylene bis(5-ethylphenol), 2,2'-methylene bis(4-n-propylphenol), 2,2'-methylene bis(4-isopropylphenol), 2,2'-methylene bis(5-n-propylphenol), 2,2'-methylene bis(5-isopropylphenol), 2,2'-methylene bis (4-n-butylphenol), 2,2'-methylene bis(4-t-butylphenol), 2,2'-methylene bis(5-n-butylphenol), 2,2'-methylene bis(5-t-butylphenol), 2,2'-methylene bis(4-t-amylphenol), 2,2'-methylene bis(4-methoxyphenol), 2,2'-methylene bis(5-methoxyphenol), 2,2'-methylene bis(4-cyanophenol), 2,2'-methylene bis(5-cyanophenol), 2,2'-methylene bis(4-nitrophenol), 2,2'-methylene bis(5-nitrophenol), 2,2'-methylene bis(4-phenylphenol), 2,2'-methylene bis(5-phenylphenol), 2,2'-methylene bis(4-cumylphenol), 2,2'-methylene bis(5-cumylphenol), 2,2'-ethylidene bisphenol, 2,2'-ethylidene bis(4-chlorophenol), 2,2'-ethylidene bis(5-chlorophenol, 2,2'-ethylidene bis(4-hydroxyphenol), 2,2'-ethylidene bis(5-hydroxyphenol), 2,2'-ethylidene bis(4-methylphenol), 2,2'-ethylidene bis(5-methylphenol), 2,2'-ethylidene bis(4-ethylphenol), 2,2'-ethylidene bis(5-ethylphenol), 2,2'-ethylidene bis(4-n-propylphenol), 2,2'-ethylidene bis(4-isopropylphenol), 2,2'-ethylidene bis(5-isopropylphenol), 2,2'-ethylidene bis(4-n-butylphenol), 2,2'-ethylidene bis(4-t-butylphenol), 2,2'-ethylidene bis(5-n-butylphenol), 2,2'-ethylidene bis(5-t-butylphenol), 2,2'-ethylidene bis(4-t-amylphenol), 2,2'-ethylidene bis(4-methoxyphenol), 2,2'-ethylidene bis(5-methoxyphenol), 2,2'-ethylidene bis(4-cyanophenol), 2,2'-ethylidene bis(5-cyanophenol), 2,2'-ethylidene bis(4-nitrophenol), 2,2'-ethylidene bis(5-nitrophenol), 2,2'-ethylidene bis(4-phenylphenol), 2,2'-ethylidene bis(5-phenylphenol), 2,2'-ethylidene bis (4-cumylphenol), 2,2'-ethylidene bis(5-cumylphenol), 2,2'-(phenylmethylene)bisphenol, 2,2'-(phenylmethylene)bis(4-chlorophenol), 2,2'-(phenylmethylene)bis(5-chlorphenol), 2,2'-(phenylmethylene)bis(4-hydroxyphenol), (phenylmethylene)bis(5-hydroxyphenol), 2,2'-(phenylmethylene)bis(4-methylphenol), 2,2'-(phenylmethylene)bis(5-methylphenol), 2,2'-(phenylmethylene)bis(4-ethylphenol), 2,2'-(phenylmethylene)bis(5-ethylphenol), 2,2'-(phenylmethylene)bis(4-propylphenol), 2,2'-(phenylmethylene)bis(4-isopropylphenol), 2,2'-(phenylmethylene)bis(5-isopropylphenol), 2,2'-(phenylmethylene)bis(4-t-butylphenol), 2,2'-(phenylmethylene)bis(5-t-butylphenol), 2,2'-(phenylmethylene)bis(4-t-amylphenol), 2,2'-(phenylmethylene)bis(4-methoxyphenol), 2,2'-(phenylmethylene)bis(5-methoxyphenol), 2,2'-(phenylmethylene)bis(4-cyanophenol), 2,2'-(phenylmethylene)bis(5-cyanophenol), 2,2'-(phenylmethylene)bis(4-nitrophenol), 2,2'-(phenylmethylene)bis(5-nitrophenol), 2,2'-(phenylmethylene)bis(4-phenylphenol), 2,2'-(phenylmethylene)bis(5-phenylphenol) and the like.

The preferred condensation products (two ring condensation product) may include 2,2'-methylene bis(4-methylphenol), 2,2'-methylene bis(4-ethylphenol), 2,2'-methylene bis (4-isopropylphenol), 2,2'-methylene bis(4-t-butylphenol), 2,2'-methylene bis(4-n-propylphenol), 2,2'-methylene bis(4-n-butylphenol), 2,2'-methylene bis(4-t-amylphenol), 2,2'-methylene bis(4-cumylphenol), 2,2'-ethylidene bis(4-methylphenol), 2,2'-ethylidene bis(4-ethylphenol), 2,2'-ethylidene bis(4-isopropylphenol), 2,2'-ethylidene bis(4-t-butylphenol), 2,2'-ethylidene bis(4-n-butylphenol), 2,2'-ethylidene bis(4-t-amylphenol), 2,2'-ethylidene bis(4-cumylphenol), 2,2'-butylidene bis(4-methylphenol), 2,2'-butylidene bis(4-t-butylphenol) and the like. Of these, 2,2'-methylene bis(4-methylphenol), 2,2'-methylene bis(4-isopropylphenol), 2,2'-methylene bis(4-t-butylphenol), 2,2'-methylene bis(4-n-butylphenol), 2,2'-methylene bis(4-n-propylphenol), 2,2'-methylene bis(4-t-amylphenol), 2,2'-methylene bis(4-cumylphenol), 2,2'-ethylidene bis(4-t-butylphenol) and 2,2'-butylidene bis(4-t-butylphenol) are particularly preferred.

The specific examples of the 3 to 5 rings condensation product of the phenol derivatives represented by chemical formula 1, which is a condensation products with p=1 to 3 in chemical formula 1,are those corresponding to the compounds cited as specific examples of the two ring condensation products described above.

The phenol derivatives of (1) are preferably two ring condensation products or mixed condensation products containing mainly two ring condensation products and also containing at least one condensation product containing at least three rings, preferably containing three rings to five rings.

In such a mixed condensation product, the content of the two ring condensation product is preferably from 40% to 99%, more preferably from 45% to 98%, even more preferably from 46% to 90%, particularly preferably from 48% to 85% and exceptionally preferably from 50% to 80%. That is, the desired improvements in the sensitivity of thermosensitive recording medium and storage stability of the color developed image and the background are not realized sufficiently when the content of the two ring condensation product is less than 40% or greater than 99%. The term "%" signifies the "area %" in the high performance liquid chromatography analytical results.

The phrase "at least one of three ring to five ring condensation products" signifies either (a) three ring condensation products, (b) a mixture of three ring condensation products and four ring condensation products, or (c) a mixture of three ring condensation products, four ring condensation products and five ring condensation products. The phrase "contains mainly two ring condensation products" signifies that the proportion of two ring condensation products is greater than the proportion of other condensation products present in the mixed condensation product. The mixed condensation product described above may also contain condensation products of chemical formula 1 in which n is at least 4, that is condensation products containing at least 6 rings.

As phenol derivatives of (1), alkyl phenol formalin condensation products such as Tomilac 224 (trade name) manufactured by API Corporation and the like, for example, can be ideally used.

Such alkyl phenol formalin condensation products may be produced using the method described in the International Publication WO 2002/098674 pamphlet etc. For example, the condensation product may be readily obtained by using a well known synthetic method in which a substituted phenol and a ketone compound or an aldehyde compound are allowed to react in the presence of an acid catalyst, which is, for example, hydrochloric acid, p-toluene sulfonic acid and the like. The reaction is allowed to occur in a suitable organic solvent that can dissolve the starting materials and reaction products and is inert to the reaction, which is, for example, water, methanol, ethanol, n-propyl alcohol, isopropyl alcohol, acetonitrile, toluene, chloroform, diethyl ether, N,N-dimethyl acetamide, benzene, chlorobenzene, dichlorobenzene, diethylketone, ethyl methyl ketone, acetone, tetrahydrofuran and the like, for several hours to several tens of hours at a reaction temperature of 0° C. to 150° C. After the reaction, the product is obtained in good yield by removing the unreacted substituted phenol using distillation.

As specific examples of the substituted phenols, phenol, p-chlorophenol, m-chlorophenol, o-chlorophenol, catechol, resorcinol, hydroquinone, p-cresol, m-cresol, o-cresol, p-ethylphenol, m-ethylphenol, o-ethylphenol, p-propylphenol, o-propylphenol, p-isopropylphenol, m-isopropylphenol, o-isopropylphenol, p-t-butylphenol, m-t-butylphenol, o-t-butylphenol, p-t-amylphenol, p-methoxyphenol, m-methoxyphenol, o-methoxyphenol, p-cyanophenol, m-cyanophenol, o-cyanophenol, p-nitrophenol, m-nitrophenol, o-nitrophenol, p-phenylphenol, m-phenylphenol, o-phenylphenol, p-cumylphenol, m-cumylphenol, o-cumylphenol, p-(a-methylbenzyl)phenol and the like may be cited.

As specific examples of the ketone and aldehyde compounds, dimethyl ketone, diethyl ketone, ethyl methyl ketone, methyl isobutyl ketone, formaldehyde, benzaldehyde and the like may be cited but are not limited to the examples.

The specific examples of the phenol derivatives (2), which is a condensation products with p=0 in chemical formula 1, which is, for example, 2) to 6) of chemical formula 4, may include, for example:

(A) 4-Hydroxy-4'-isopropoxy diphenyl sulfone, 4-hydroxy-4'-n-propoxy diphenyl sulfone, 4-hydroxy-4'-2-propylenoxy diphenyl sulfone, 4-hydroxy-4'-l-propenyl diphenyl sulfone, 4-hydroxy-4'-ethoxy diphenyl sulfone, 4-hydroxy-4'-n-butoxy diphenyl sulfone, 4-hydroxy-4'-benzoxy diphenyl sulfone and the like may be cited. 4-Hydroxy-4'-isopropoxy diphenyl sulfone, 4-hydroxy-4'-n-propoxy diphenyl sulfone and 4-hydroxy-4'-allyloxy diphenyl sulfone are particularly preferred from the standpoint of color developing sensitivity.

As such phenol derivatives, Tomilac KN (trade name) manufactured by API Corporation, D-8 (trade name) manufactured by Nippon Soda Co., Ltd., BPS-MAE (trade name) manufactured by Nicca Chemical Co., Ltd. and the like, for example, may be cited.

(B) N-(4'-hydroxyphenolthio)acetyl-4-hydroxyaniline, N-(4'-hydroxyphenolthio)acetyl-2-hydroxyaniline, N-(2'-hydroxyphenolthio) acetyl-4-hydroxyaniline, N-(3'-hydroxyphenolthio) acetyl-4-hydroxyaniline, N-(2'-hydroxyphenolthio)acetyl-2-hydroxyaniline, N-(3'-hydroxyphenolthio) acetyl-2-hydroxyaniline and the like may be cited. Of these, N-(4'-hydroxyphenolthio)acetyl-4-hydroxyaniline and N-(4'-hydroxyphenolthio) acetyl-2-hydroxyaniline are preferred.

As such phenol derivatives, D-100 (trade name) and D-102 (trade name) manufactured by Nippon Soda Co., Ltd. and the like, for example, may be cited.

(C) 2,4'-Dihydroxy diphenyl sulfone

As such phenol derivatives, 2,4-Bisphenol S (trade name) manufactured by Nicca Chemical Co., Ltd., for example, may be cited.

(D) bis(3-Allyl-4-hydroxyphenyl) sulfone

As such phenol derivatives, TG-SA (trade name), TG-SH (trade name) manufactured by Nippon Kayaku Co., Ltd. and the like, for example, may be cited.

(E) Bisphenols such as 2,2-(4-hydroxyphenyl) propane, 4,4'-1-phenylethylidene bisphenol and the like.

As such phenol derivatives BPA (trade name) manufactured by Mitsui Chemical, Inc., Bisphenol AP (trade name) manufactured by Honshu Chemical Industry Co. Ltd. and the like, for example, may be cited.

These phenol derivatives may be used individually or as mixtures.

The diphenyl sulfone derivative used in the present invention as the second color developing agent is represented by the following chemical formula 2.

[chemical formula 2]

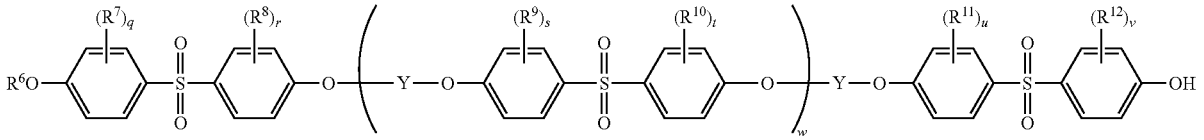

wherein, $R^6$ represents a linear or branched, saturated or unsaturated hydrocarbon group containing 1 to 12, preferably 1 to 5 and more preferably 1 to 4, carbon atoms, and methyl, ethyl, n-propyl, isopropyl, n-butyl, t-butyl and, isoamyl groups and the like, for example, may be cited as the saturated hydrocarbon group. In addition, the number of carbon atoms in the unsaturated hydrocarbon group is preferably from 2 to 5, and ethylene, 1-n-propylene, 2-n-propylene, isopropylene, 1-n-butylene, 2-n-butylene, and 3-n-butylene groups and the like, for example, may be cited as the unsaturated hydrocarbon group.

$R^7$ to $R^{12}$ independently represent halogen atoms and alkyl or alkenyl groups containing 1 to 12 carbon atoms. As the halogen atom, chlorine, bromine, fluorine and iodine may be cited, but chlorine and bromine are preferred.

The alkyl groups of $R^7$ to $R^{12}$ represent linear or branched, saturated hydrocarbon groups containing 1 to 12 carbon atoms, and the number of carbon atoms in the saturated hydrocarbon groups is preferably 1 to 5 and more preferably 1 to 4. For example, methyl, ethyl, n-propyl, isopropyl, n-butyl, t-butyl, n-pentyl, isopentyl, neopentyl, t-pentyl, n-hexyl, isohexyl, 1-methylpentyl, and 2-methylpentyl groups and the like, for example may be cited.

The alkenyl groups of $R^7$ to $R^{12}$ represent linear or branched unsaturated hydrocarbon groups containing 2 to 12 carbon atoms. For example, vinyl, allyl, isopropenyl, 1-propenyl, 2-butenyl, 3-butenyl, 1,3-butane dienyl, and 2-methyl-2-propenyl groups and the like, for example, may be cited. Of these, vinyl groups and ally groups are preferred.

q, r, s, t, u and v represent integers of 0 to 4, but 0 to two are preferred and 0 is more preferred. However, when q, r, s, t, u and v are two to four, $R^7$ to $R^{12}$ may be identical to or different from each other, but q, r, s, t, u and v being the same is preferred.

Y may independently represent linear or branched, saturated or unsaturated hydrocarbon groups that may also contain ether bonds, but linear saturated hydrocarbons that may also contain ether bonds are preferred and linear saturated hydrocarbons that do not contain ether bonds are more preferred.

As specific examples of the saturated hydrocarbon groups of Y, methylene, ethylene, trimethylene, tetramethylene, pentamethylene, hexamethylene, heptamethylene, octamethylene, nonamethylene, decamethylene, undecamethylene, dodecamethylene, methyl methylene, dimethyl methylene, methyl ethylene, methylene ethylene, ethyl ethylene, 1,2-dimethylethylene, 1-methyl trimethylene, 1-methyl tetramethylene, 1,3-dimethyl trimethylene, and 1-ethyl-4-methyl tetramethylene groups and the like may be cited. Of these, saturated hydrocarbon groups containing 2 to 6 carbon atoms such as ethylene, trimethylene, tetramethylene, pentamethylene, and hexamethylene groups and the like are preferred.

As the unsaturated hydrocarbon groups of Y, linear or branched unsaturated hydrocarbon groups containing 1 to 12 carbon atoms may be cited. Hydrocarbon groups containing 2 to 6 carbon atoms are preferred, and those containing 2 to 4 carbon atoms are more preferred. As specific examples of the unsaturated hydrocarbon groups, vinylene, ethenylene, propenylene, 2-butenylene, 2-butynylene, and 1-vinylethylene groups and the like may be cited. Of these, aromatic hydrocarbon groups such as propenylene groups, 2-butenylene groups and the like are preferred.

As the hydrocarbon groups containing ether bonds, ethylene oxyethylene, tetramethylene oxytetramethylene, ethyleneoxy ethyleneoxy ethylene, ethyleneoxy methyleneoxy ethylene, and 1,3-dioxane-5,5-bismethylene groups and the like, for example, may be cited. Of these, ethylene oxyethylene groups and ethyleneoxy ethyleneoxy ethylene groups are preferred.

w represents an integer of 0 to 5, but w that is 0 to two is preferred and 0 is more preferred.

The diphenyl sulfone derivative described above may be a compound containing a specific w in the chemical formula 2 or may be a mixture in optional proportion of the compounds of the chemical formula 2 with different w's.

As the diphenyl sulfone derivative of the chemical formula 2, the following compounds, for example, may be cited but examples are not limited to these compounds.

1-[4-(4-hydroyxphenylsulfonyl) phenoxy]-2-[4-(4-isopropoxyphenylsulfonyl)phenoxy]ethane, 1-[4-(4-hydroxyphenylsulfonyl)phenoxy]-3-[4-(4-isopropoxyphenyl sulfonyl) phenoxy]propane, 1-[4-(4-hydroxyphenylsulfonyl) phenoxy]-4-[4-(4-isopropoxyphenylsulfonyl)phenoxy]butane, 1-[4-(4-hydroxyphenylsulfonyl)phenoxy]-5-[4-(4-isopropxyphenylsulfonyl) phenoxy]pentane, 1-[4-(4-hydroxyphenylsulfonyl) phenoxy]-6-[4-(4-isopropoxyphenylsulfonyl)phenoxy]hexane, 1-[4-(4-hydroxyphenylsulfonyl)phenoxy]-7-[4-(4-isopropoxyphenylsulfonyl) phenoxy]heptane, 1-[4-(4-hydroxyphenylsulfonyl) phenoxy]-8-[4-(4-isopropoxyphenylsulfonyl)phenoxy]octane, 4-(4-[4-(4-hydroxyphenylsulfonyl)phenoxy]butoxy)-4'-(4-[4-(4-methoxyphenylsulfonyl)phenoxy]butoxy) diphenyl sulfone, 4-(4-(2-(4-(4-(2-(4-(4-(2-(4-(4-ethoxyphenylsulfonyl) phenoxy)butoxy)phenylsulfonyl)phenoxy)butoxy)phenylsulfonyl)phenoxy)butoxy)phenylsulfonyl)phenol and the like may be cited. Of these, 1-(4-(4-hydroxyphenylsulfonyl)phenoxy)-4-(4-(4-isopropoxyphenylsulfonyl) phenoxy)butane is preferred from the standpoints of color development sensitivity and storage stability.

As clarified by the examples presented later, the color developing sensitivity declines when a diphenylsulfone derivative is used singly as the color developing agent in a thermosensitive color developing layer but the color developing sensitivity can be improved when a phenol derivative of the present invention is used in combination. When a diphenyl sulfone derivative is used in less than the amount of the phenol derivative used, the balance among other properties (color developing sensitivity, moist heat resistance and plasticizer resistance) improves.

The ratio at which a phenol derivative that is the color developing agent and a diphenyl sulfone derivative in a thermosensitive color developing layer are used ([phenol derivative: diphenyl sulfone derivative (weight ratio)] is preferably 95:5 to 55:45, but 90:10 to 60:40 is more preferred.

Other color developing agent than those may also be used in combination in a thermosensitive color developing layer. However such a color developing agent is preferably used at 50 wt. % or less, more preferably 0 wt. % to 30 wt. % or most preferably not used per the sum of the phenol derivative and diphenylsulfone derivative.

As the color developing agent that can be used in combination in the present invention, all of the well known color developing agents used previously in pressure sensitive or thermosensitive recording media may be used with no specific restrictions. However, such color developing agent includes inorganic acidic substances such as activated clay, attapulgite, colloidal silica, aluminum silicate and the like, 1,1-bis(4-hydroxyphenyl) cyclohexane, hydroquinone monobenzyl ether, benzyl 4-hydroxy benzoate, 3,4-dihydroxyphenyl-4'-methylphenylsulfone, the aminobenzene sulfone amide derivative described in Japanese Patent Application Public Disclosure No. H08-59603, bis(4-hydroxyphenyl thioethoxy)methane, 1,5-di(4-hydroxyphenylthio)-3-oxapentane, butyl bis(p-hydroxyphenyl)acetate, methyl bis (p-hydroxyphenyl)acetate, 1,4-bis[α-methyl-α-(4'-hydroxyphenyl)ethyl]benzene, 1,3-bis[α-methyl-α-(4'-hydroxyphenyl)ethyl]benzene, 2,2'-thio-bis(3-tert-octylphenol), 2,2'-thio-bis(4-tert-octylphenol), the compound described in International Publication WO 2002/081229 pamphlet or Japanese Patent Application Public Disclosure No. 2002-301873, and also thiourea compounds such as N,N'-di-m-chlorophenyl thiourea and the like; aromatic carboxylic acids such as p-chlorobenzoic acid, stearyl gallate, zinc bis[4-(n-octyloxy carbonylamino)salicylate]dihydrate, 4-[2-(p-methoxyphenoxy)ethyloxy]salicylic acid, 4-[3-(p-trisulfonyl) propylenoxy]salicylic acid, 5-[p-(2-p-methoxyphenoxyethoxy)cumyl]salicylic acid; the salts of these aromatic carboxylic acids with polyvalent metals such as zinc, magnesium, aluminum, calcium, titanium, manganese, tin, nickel and the like; and, furthermore, antipyrin complexes of zinc thiocyanate and composite zinc salts of terephthalaldehyde acid with other aromatic carboxylic acid and the like. These color developing agents may be used individually or as mixtures of at least two. A metal chelate type color developing component such as the high molecular weight fatty acid metal complex salts described in Japanese Patent Application Public Disclosure No. H10-258577 and metal chelate type color developing components such as a polyvalent hydroxyl aromatic compound and the like may also be present.

Furthermore, examples of other materials used in the thermosensitive color developing layer of the present invention are listed. Binders, crosslinking agents, pigments and the like may be used in the thermosensitive color developing layer in ranges that do not interfere with the desired effects on the tasks described above. In addition, the materials may also be used not only in the thermosensitive color developing layer but also in protective layers and individual coating layers installed as needed.

As the electron donating leuco dye used in the present invention, all of the well known electron donating leuco dyes used previously in pressure sensitive or thermosensitive recording media may be used with no specific restrictions. However, triphenylmethane type compounds, fluorane type compounds, fluorene type compounds, divinyl type compounds and the like are preferred. Specific examples of the typical colorless or pale dye (dye precursors) are shown below. In addition, the dye precursors may be used individually or as mixtures of at least two of them.

<Triphenylmethane Type Leuco Dyes>

3,3-bis(p-dimethyl aminophenyl)-6-dimethylaminophthalide [alternate name: crystal violet lactone] and 3,3-bis(p-dimethyl aminophenyl)phthalide [alternate name: malachite green lactone]

<Fluorane Type Leuco Dyes>

3-Diethylamino-6-methylfluorane, 3-diethylamino-6-methyl-7-anilinofluorane, 3-diethylamino-6-methyl-7-(o,p-dimethylanilino)fluorane, 3-diethylamino-6-methyl-7-chlorofluoran, 3-diethylamino-6-methyl-7-(m-trifluoromethylanilino)fluorane, 3-diethylamino-6-methyl-7-(o-chloroanilino)fluorane, 3-diethylamino-6-methyl-7-(p-chloroanilino)fluorane, 3-diethylamino-6-methyl-7-(o-fluoroanilino)fluorane, 3-diethylamino-6-methyl-7-(m-methylanilino)fluorane, 3-diethylamino-6-methyl-7-n-octylanilino fluorane, 3-diethylamino-6-methyl-7-n-octylamino fluorane, 3-diethylamino-6-methyl-7-benzylamino fluorane, 3-diethylamino-6-methyl-7-dibenzylamino fluorane; 3-diethylamino-6-chloro-7-methyl fluorane, 3-diethylamino-6-chloro-7-anilino fluorane, 3-diethylamino-6-chloro-7-p-methylanilino fluorane, 3-diethylamino-6-ethoxyethyl-7-anilino fluorane, 3-diethylamino-7-methyl fluorane, 3-diethylamino-7-chloro fluorane, 3-diethylamino-7-(m-trifluoromethylanino)fluorane, 3-diethylamino-7-(o-chloroanilino)fluorane, 3-diethylamino-7-(p-chloroanilino) fluorane, 3-diethylamino-7-(o-fluoroanilino)fluorane, 3-diethylamino-benz[a]fluorine; 3-diethylamino-benz[c]fluorane, 3-dibutylamino-6-methyl-fluorane, 3-dibutylamino-6-methyl-7-anilino fluorane, 3-dibutylamino-6-methyl-7-(o,p-dimethylanilino) fluorane, 3-dibutylamino-7-(o-chloroanilino)fluorane, 3-butylamino-6-methyl-7-(p-chloroanilino)fluorane, 3-dibutylamino-6-methyl-7-(o-fluoroanilino)fluorane, 3-dibutylamino-6-methyl-7-(m-fluoroanilino)fluorane, 3-dibutylamino-6-methyl-chloro fluorane, 3-dibutylamino-6-ethoxyethyl-7-anilino fluorane, 3-dibutylamino-6-chloro-7-anilino fluorane, 3-dibutylamino-6-methyl-7-p-methylanilino fluorane, 3-dibutylamino-7-(o-chloroanilino)fluorane, 3-dibutylamino-7-(o-fluoroanilino)fluorane, 3-di-n-pentylamino-6-methyl-7-anilino fluorane, 3-di-n-pentylamino-6-methyl-7-(p-chloroanilino)fluorane, 3-di-n-pentylamino-7-(m-trifluoromethylanilino)fluorane, 3-di-n-pentylamino-6-chloro-7-anilino fluorane, 3-di-n-pentylamino-7-(p-chloroanilino)fluorane, 3-pyrolidino-6-methyl-7-anilino fluorane, 3-piperidino-6-methyl-7-anilino fluorane, 3-(N-methyl-N-propylamino)-6-methyl-7-anilino fluorane, 3-(N-methyl-N-cyclohexylamino)-6-methyl-7-anilino fluorane, 3-(N-ethyl-N-cyclohexylamino)-6-methyl-7-anilino fluorane, 3-(N-ethyl-N-xylylamino)-6-methyl-7-(p-chloroanilino)fluorane, 3-(N-ethyl-p-toluidino)-6-methyl-7-anilino fluorane, 3-(N-ethyl-N-isoamylamino)-6-methyl-7-anilino fluorane, 3-(N-ethyl-N-isoamylamino)-6-chloro-7-anilino fluorane, 3-(N-ethyl-N-tetrahydrofurfurylamino)-6-methyl-7-anilino fluorane, 3-(N-ethyl-N-isobutylamino)-6-methyl-7-anilino fluorane, 3-(N-ethyl-N-ethoxypropylamino)-6-methyl-7-anilino fluorane, 3-cyclohexylamino-6-chloro fluorane, 2-(4-oxahexyl)-3-dimethylamino-6-methyl-7-anilino fluorane, 2-(4-oxahexyl)-3-diethylamino-6-methyl-7-anilino fluorane, 2-(4-oxahexyl)-3-dipropylamino-6-methyl-7-anilino fluorane, 2-methyl-6-p-(p-dimethylaminophenyl)aminoanilino fluorane, 2-methoxy-6-p-(p-dimethylaminophenyl)aminoanilino fluorane, 2-chloro-3-methyl-6-p-(p-phenylaminophenyl)aminoanilino fluorane, 2-chloro-6-p-(p-dimethylaminophenyl)aminoanilino fluorane, 2-nitro-6-p-(p-diethylaminophenyl)aminoanilino fluorane, 2-amino-6-p-(p-diethylaminophenyl)aminoanilino fluorane, 2-diethylamino-6-p-(p-diethylaminophenyl)aminoanilino fluorane, 2-phenyl-6-methyl-6-p-(p-phenylaminophenyl)aminoanilino fluorane, 2-benzyl-6-p-(p-phenylaminophenyl)aminoanilino fluorane, 2-hydroxy-6-p-(p-phenylaminophenyl)aminoanilino fluorane, 3-methyl-6-p-(p-dimethylaminophenyl)aminoanilino fluorane, 3-diethylamino-6-p-(p-diethylaminophenyl)aminoanilino fluorane, 3-diethylamino-6-p-(p-dibutylaminophenyl)aminoanilino fluorane and 2,4-dimethyl-6-[(4-dimethylamino) anilino]fluorane.

<Fluorene Type Leuco Dye>

3,6,6-Tris(dimethylamino) spiro[fluorene-9,3'-phthalide] and 3,6,6'-tris (diethylamino)spiro[fluorene-9,3'-phthalide].

<Divinyl Type Leuco Dyes>

3,3-bis-[2-(p-dimethyl aminophenyl)-2-(p-methoxyphenyl)ethenyl]-4,5,6,7-tetrabromophthalide, 3,3-bis-[2-(p-dimethylaminophenyl)-2-(p-methoxyphenyl)ethenyl]-4,5,6,7-tetrachlorophthalide, 3,3-bis-[1,1-bis(4-pyrolidinophenyl) ethylene-2-yl]-4,5,6,7-tetrabromophthalide and 3,3-bis-[1-(4-methoxyphenyl)-1-(4-pyrolydinophenyl)ethylene-2-yl]-4,5,6,7-tetrchlorophthalide.

<Others>

3-(4-Diethylamino-2-ethoxyphenyl)-3-(1-ethyl-2-methylindol-3-yl)-4-azaphthalide, 3-(4-diethylamino-2-ethoxyphenyl)-3-(1-octyl-2-methylindol-3-yl)-4-azaphthalide, 3-(4-cyclohexyl ethylamino-2-methoxyphenyl)-3-(1-ethyl-2-methylindol-3-yl)-4-azaphthalide, 3,3-bis(1-ethyl-2-methylindol-3-yl)phthalide, 3,6-bis(diethylamino)fluorane-γ-(3'-nitro)anilinolactam, 3,6-bis(diethylamino)fluorane-γ-(4'-nitro)anilinolactam, 1,1-bis-[2',2',2',2"-tetrakis-(p-dimethylaminophenyl)-ethenyl]-2,2-dinitrilethane, 1,1-bis-[2',2',2',2"-tetrakis-(p-dimethylaminophenyl)-ethenyl]-2-β-naphthoylethane, 1,1-bis-[2',2',2',2"-tetrakis-(p-dimethylaminophenyl)-ethenyl]-2,2-diacetylethane and bis-[2,2,2',2'-tetrakis-(p-dimethylaminophenyl)-ethenyl]-methylmalonic acid dimethyl ester.

As the sensitizer used in the present invention, previously well known sensitizers may be used. Such sensitizer includes, for example, 1,2-di-(3-methylphenoxy)ethane, bis-para-methylbenzyl oxalate, benzyloxy naphthalene, 1,2-di-(3-methylphenoxy)ethane, aliphatic acid amides such as stearic acid amide, palmitic acid amide and the like, ethylene bis-amide, montanoic acid wax, polyethylene wax, p-benzyl biphenyl, p-benzyloxy naphthalene, 4-biphenyl-p-tolyl ether, m-terphenyl, 1,2-diphenoxy ethane, dibenzyl oxalate, di-(p-chlorobenzyl)oxalate, dibenzyl terephthalate, benzyl p-benzyloxybenzoate, di-p-tolyl carbonate, phenyl-α-naphthyl carbonate, 1,4-diethoxy naphthalene, 1-hydroxy-2-naphthoic acid phenyl ester, o-xylene-bis-(phenyl ether), 4-(m-methylphenoxymethyl)biphenyl, 4,4'-ethylene dioxy-bis-benzoic acid dibenzyl ester, dibenzoyloxy methane, 1,2-di(3-methylphenoxy)ethylene, bis[2-(4-methoxy phenoxy)ethyl] ether, methyl p-nitrobenzoate and phenyl p-toluene sulfonate. However, the examples are not particularly restricted to the examples listed. The sensitizers may be used individually or as mixtures of at least two of them.

Of the sensitizers, 1,2-di-(3-methylphenoxy)ethane, bis-p-methylbenzyl oxalate and benzyloxy naphthalene are preferred since they yield good color developing sensitivity when they are combined with a color developing agent of the present invention.

As stabilizers in the present invention that impart oil resistance and the like to recorded images, 4,4'-butylidene (6-t-butyl-3-methylphenol), 2,2'-di-t-butyl-5,5'-dimethyl-4,4'-sulfonyl diphenol, 1,1,3-tris(2-methyl-4-hydroxy-5-cyclohexylphenyl)butane, 1,1,3-tris(2-methyl-4-hydroxy-5-t-butylphenyl)butane and the like may be used in combination in ranges that do not interfere with the desired effects on the tasks described above.

In a thermosensitive recording medium of the present invention, a binder, a list of examples of which include completely saponified poly(vinyl alcohol), partially saponified poly(vinyl alcohol), acetoacetylated poly(vinyl alcohol), carboxyl modified poly(vinyl alcohol), amide modified poly(vinyl alcohol), sulfonic acid modified poly(vinyl alcohol), butyral modified poly(vinyl alcohols), olefin modified poly (vinyl alcohol), nitrile modified poly(vinyl alcohol), pyrrolidone modified poly(vinyl alcohol), silicone modified poly (vinyl alcohol), other modified poly(vinyl alcohols), hydroxyethyl cellulose, methyl cellulose, ethyl cellulose, carboxymethyl cellulose, styrene-maleic anhydride copolymer, styrene-butadiene copolymer as well as cellulose derivatives such as ethyl cellulose and acetyl cellulose, casein, gum Arabic, oxidized starch, etherized starch, dialdehyde starch, esterified starch, poly(vinyl chloride), poly(vinyl acetate), polyacrylamide, polyacrylate ester, poly(vinyl butyral), polystyrose and its copolymers, polyamide resin, silicone resin, petroleum resin, terpene resin, ketone resin, cumaro resin and the like, may be present. The polymeric substances may be used upon dissolving in a solvent such as water, alcohol, ketones, esters, hydrocarbons and the like or in the form of an emulsion or paste dispersed in water or other media and in combination depending on the required qualities.

As the crosslinking agent used in the present invention, glyoxal, methylol melamine, melamine formaldehyde resins, melamine urea resins, polyamine epichlorohydrin resins, polyamide epichlorohydrin resins, potassium persulfate, ammonium persulfate, sodium persulfate, ferric chloride, magnesium chloride, borax, boric acid, alum, ammonium chloride and the like may be listed as examples.

As the pigment used in the present invention, inorganic and organic fillers such as silica, calcium carbonate, kaolin, calcined kaolin, diatomaceous earth, talc, titanium oxide, aluminum hydroxide and the like may be cited.

As the slip agent used in the present invention, fatty acid metal salts such as zinc stearate, calcium stearate and the like, wax, silicone resins and the like may be cited.

In addition, ultraviolet ray absorption agents, dispersion agents, defoaming agents, oxidation inhibitors, fluorescent dye and the like may also be used.

The types and amounts of the dye, color developing agents and various other components used in the thermosensitive color developing layer of the present invention are decided according to performance and recording properties. The amounts are not particularly limited, but the color developing agent is ordinarily used at about 0.5 to 10 weight parts per one part of dye, the sensitizer is used at about 0.5 to 10 weight parts, the stabilizing agent is used at about 0.01 to 10 weight parts and other components are used at about 0.01 to 10 weight parts.

The dye, color developing agent and other materials added when needed are ground into particles several microns in size or smaller using a grinder or emulsification device such as a ball mill, attriter, sand grinder and the like. A binder and various additives are added depending on the objective of preparing a coating solution. Water, an alcohol and the like may be used as the solvent used to prepare the coating solution, and the solid fraction is present at about 20 wt. % to 40 wt. %.

A protective layer containing as main components pigments and water soluble polymers such as poly(vinyl alcohol), starch and the like may also be installed on a thermosensitive color developing layer in a thermosensitive recording medium of the present invention.

In the present invention, the presence of a resin containing carboxyl groups, particularly poly(vinyl alcohol) modified with carboxyl groups, and epichlorohydrin type resins and polyamine type resin/polyamide type resins in the protective layer are desirable from the standpoints of heat, water and moist heat resistance.

Now, the combined use of an epichlorohydrin type resin and a polyamine type resin/polyamide type resin in the protective layer of the present invention is desirable. Adequate water resistance cannot be obtained when they are individually used, and blocking and other problems are encountered. In addition, adequate water resistance cannot be obtained even when other common crosslinking agents, for example, glyoxal and epichlorohydrin type resins or polyamine type resin/polyamide type resins are used in combination.

The resin containing carboxyl groups used as the binder in a protective layer in the present invention may be any one as long as it contains mainly carboxyl groups. For example, a resin that contains monofunctional acrylic monomer containing carboxyl groups such as methacrylic acid, 2-hydroxyethyl methacrylate, 2-hydroxypropyl methacrylate, dimethyl aminoethyl methacrylate, diethyl aminoethyl methacrylate, t-butyl aminoethyl methacrylate, glycidyl methacrylate, tetrahydro furfuryl methacrylate and the like, oxidized starch, carboxymethyl cellulose, poly(vinyl alcohol) modified with carboxyl groups obtained by introducing carboxyl groups to poly(vinyl alcohol) and the like may be cited. However, the use of a carboxyl modified poly(vinyl alcohol) with excellent heat and solvent resistance is particularly preferred.

The carboxyl modified poly(vinyl alcohol) used in the present invention is a water soluble polymer into which carboxyl groups have been introduced for the purpose of enhancing the reactivity and is a reaction product of poly(vinyl alcohol) with a polyvalent carboxylic acid such as fumaric acid, phthalic anhydride, mellitic anhydride, itaconic anhydride and the like or an ester of the reaction product, or a saponified copolymer of vinyl acetate with a dicarboxylic acid with ethylene type unsaturation such as maleic acid, fumaric acid, itaconic acid, crotonic acid, acrylic acid, methacrylic acid and the like. More specifically, the product is obtained using the production process listed as examples in, for example, Japanese Patent Application Public Disclosure No. S53-91995.

Furthermore, the carboxyl modified poly(vinyl alcohol) used in the present invention has a low Hercules viscosity. That is, the material is very fluid under high shear conditions but is viscous under low shear force conditions. For that reason, a coating fluid spreads smoothly when applied but forms a coating layer that solidifies immediately after application, is uniform and smooth. Thus the image quality of printed images and sensitivity are thought to improve. In addition, carboxyl modified poly(vinyl alcohol) has excellent water retention, and the binder penetration into the support material can be suppressed. The feature allows a smooth coating layer to form and is thought to improve image quality and sensitivity.

The degree of polymerization and saponification of the carboxyl modified poly(vinyl alcohol) used in the present invention may be appropriately selected based on the water retention of the coating and the surface strength of the coating layer.

As specific examples of the epichlorohydrin type resin used in the present invention, polyamide epichlorohydrin resins, polyamine epichlorohydrin resins and the like may be cited and may be used individually or jointly. In addition, as the amine present in the main chain of the epichlorohydrin type resin, primary to quaternary amines may be used without particular restrictions. Furthermore, a degree of cationization of 5 meq/g·solid or less (measured at pH 7) and a molecular weight of at least 500,000 are preferred based on good water resistance. As specific examples, Sumirez resin 650 (30), Sumirez resin 675A, Sumirez resin 6615 (all manufactured by Sumitomo Kagaku), WS 4002, WS 4020, WS 4024, WS 4030, WS 4046, WS 4010, CP 8970 (all manufactured by Seiko PMC Corporation) and the like may be cited.

In the present invention, the polyamine type resin/polyamide type resin signifies a polyamine type resin and/or polyamide type resin and the polyamine type resin/polyamide type resin includes polyamine resins, polyamide resins, polyamide urea type resins, poly(ethylene imine) resins, polyalkylene polyamine resins, polyalkylene polyamide resins, polyamine polyurea type resins, modified polyamine resins, modified polyamide resins, polyalkylene polyamine urea formalin resins, polyalkylene polyamine polyamide polyurea resins and the like. They may be used alone or in combinations of at least two of them. As specific examples, Sumirez resin 302 (a polyamine polyurea type resin manufactured by Sumitomo Chemical Co. Ltd.), Sumirez resin 712 (a polyamine polyurea type resin manufactured by Sumitomo Chemical Co. Ltd.), Sumirez 703 (a polyamine polyurea type resin manufactured by Sumitomo Chemical Co. Ltd.), Sumirez 636 (a polyamine polyurea type resin manufactured by Sumitomo Chemical Co. Ltd.), Sumirez resin SPI-100 (a modified polyamine resin manufactured by Sumitomo Chemical Co. Ltd.), Sumirez resin SPI-102A (a modified polyamide resin manufactured by Sumitomo Chemical Co. Ltd.), Sumirez resin SPI-106N (a modified polyamide resin manufactured by Sumitomo Chemical Co. Ltd.), Sumirez resin SPI-203(50) (a polyamide resin manufactured by Sumitomo Chemical Co. Ltd.), Sumirez resin SPI-198 (a polyamide resin manufactured by Sumitomo Chemical Co. Ltd.), Printive A-600 (manufactured by Asahi Kasei Corporation), Printive A-500 (manufactured by Asahi Kasei Corporation), PA 6500 (polyalkylene polyamine urea formalin resin manufactured by Seiko PMC Corporation), PA 6504 (polyalkylene polyamine urea formalin resin manufactured by Seiko PMC Corporation), PA 6634, PA 6638, PA 6640, PA 6644, PA 6646, PA 6654, PA6702, PA 6704 (all polyalkylene polyamine polyamide polyurea resin manufactured by Seiko PMC Corporation), CP 8994 (a polyethylene imine resin manufactured by Seiko PMC Corporation) and the like may be cited. Although there are no particular restrictions, the use of polyamine type resins (polyalkylene polyamine resins, polyamine polyurea type resins, modified polyamine resins, polyalkylene polyamine urea formalin resins, polyalkylene polyamine polyamide polyurea resins) is desirable based on the color developing sensitivity.

The concentrations of the epichlorohydrin type resin and polyamine type resin/polyamide type resin used in the present invention are preferably 1 to 100 parts by weight, more preferably 5 to 50 parts by weight, respectively, per 100 parts by weight of the carboxyl modified poly(vinyl alcohol). When the concentrations are too low, the crosslinking reaction is inadequate and good water resistance cannot be obtained. When the concentrations are too high, operational problems are experienced due to viscosity increases in the coating solution and gel formation. In addition, epichlorohydrin type resins undergo crosslinking reactions at pH of 6.0 or higher, and the pH of the protective layer coating is preferably adjusted to 6.0 or higher.

The types and amounts of various components used in the protective layer of the present invention are decided according to the performance and recording properties. The amounts are not particularly limited, but the poly(vinyl alcohol) is ordinarily used at 10 to 500 parts by weight per 100 parts by weight of the pigment and the crosslinking agent component is used at 1 to 100 parts by weight per 100 parts by weight of the poly(vinyl alcohol).

The materials are ground into fine particles several microns or smaller in size using a grinder or suitable emulsification device such as a ball mill, an attriter, a sand grinder and the like. A binder and various additives are added depending on the objective to prepare a coating solution. Water, alcohol and the like may be used as the solvent to prepare the coating solution, and the solid fraction is present at about 20 wt. % to 40 wt. %.

The pigment used in a protective layer of the present invention may be kaolin, (calcined) kaolin, calcium carbonate, aluminum oxide, titanium oxide, magnesium carbonate, aluminum silicate, magnesium silicate, calcium silicate, aluminum hydroxide, diatomaceous earth, talc and the like. The concentrations of the pigment and binder in the protective layer of the present invention are about 30 to 300 parts by weight in terms of the solid fraction of the binder per 100 parts by weight of the pigment.

EXAMPLES

The following examples will illustrate the present invention, but these are not intended to restrict the present invention.

In the examples and comparative examples below, an undercoating layer, a thermosensitive color developing layer (a recording layer) and a protective layer when necessary were formed on one side of a support material. In the description, the terms parts and % indicate parts by weight and wt. %, respectively.

The individual coating solutions for a thermosensitive recording medium were prepared as described below.

| Undercoating layer coating solution | |
|---|---|
| Calcined kaolin (Ansilex 90 manufactured by BASF Co.) | 90 parts |
| Styrene-butadiene copolymer latex (solid content: 50%) | 10.0 parts |
| Water | 50.0 parts |

The mixture comprising the composition described above was blended and agitated to prepare an undercoating layer coating solution.

Thermosensitive Color Developing Layer Coating Solution

The solutions A through D were separately wet ground using sand grinders until the average particle size was about 0.5 μm.

| Solution A-1 (color development agent dispersion) | |
|---|---|
| Alkylphenol formalin condensation product (Tomilac 224 manufactured by API Corporation) | 6.0 parts |
| 10% Aqueous solution of poly(vinyl alcohol) | 5.0 parts |
| Water | 1.5 parts |

| Solution A-2 (color development agent dispersion) | |
|---|---|
| Diphenylsulfone crosslinking type compound (D-90* manufactured by Nippon Soda Co., Ltd.) | 6.0 parts |
| 10% Aqueous solution of poly(vinyl alcohol) | 5.0 parts |
| Water | 1.5 parts |

*D-90 is represented by the formula below.

[chemical formula 7]

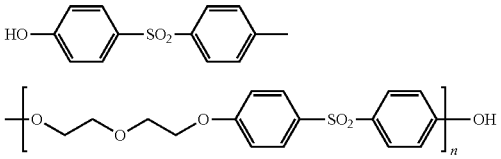

(a mixture of n = 1-11)

| Solution A-3 (color development agent dispersion) | |
|---|---|
| 4-Hydoxy-4'-isopropoxy diphenyl sulfone (shown by the formula 8 below) | 6.0 parts |
| 10% Aqueous solution of poly(vinyl alcohol) | 5.0 parts |
| Water | 1.5 parts |

[chemical formula 8]

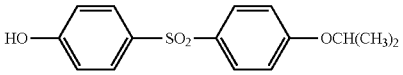

| Solution A-4 (color development agent dispersion) | |
|---|---|
| bis (3-allyl-4-hydroxyphenyl) sulfone (TG-SA* manufactured by Nippon Kayaku Co., Ltd.) | 6.0 parts |

-continued

| Solution A-4 (color development agent dispersion) | |
|---|---|
| 10% Aqueous solution of poly(vinyl alcohol) | 5.0 parts |
| Water | 1.5 parts |

*TG-SA is represented by the formula 9 below.

[chemical formula 9]

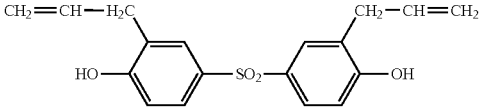

| Solution A-5 (color development agent dispersion) | |
|---|---|
| 4-Hydroxy-4'-n-propoxy diphenyl sulfone (Tomilac KN* manufactured by API Corporation) | 6.0 parts |
| 10% Aqueous solution of poly(vinyl alcohol) | 5.0 parts |
| Water | 1.5 parts |

*Tomilac KN is represented by the formula 10 below.

[chemical formula 10]

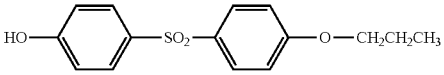

| Solution A-6 (color development agent dispersion) | |
|---|---|
| 4-Hydroxy-4'-allyloxy diphenyl sulfone (BPS-MAE* manufactured by Nicca Chemical Co., Ltd.) | 6.0 parts |
| 10% Aqueous solution of poly(vinyl alcohol) | 5.0 parts |
| Water | 1.5 parts |

*BPS-MAE is represented by the formula 11 below.

[chemical formula 11]

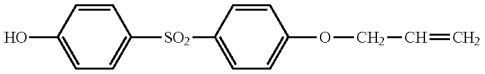

| Solution A-7 (color development agent dispersion) | |
|---|---|
| 2,4'-Dihydroxy diphenyl sulfone (2,4 Bisphenol S* manufactured by Nicca Chemical Co., Ltd.) | 6.0 parts |
| 10% Aqueous solution of poly(vinyl alcohol) | 5.0 parts |
| Water | 1.5 parts |

*2,4 Bisphenol S is represented by the formula 6 below.

[chemical formula 6]

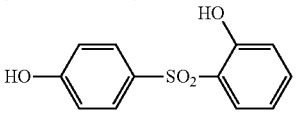

| Solution A-8 (color development agent dispersion) | |
|---|---|
| A 1:1 mixture of N-(4'-hydroxyphenylthio) acetyl-2-hydroxyaniline [the formula 5 (b) below] and N-(4'-hydroxyphenylthio)acetyl-4-hydroxyaniline [the formula 5 (a) below](D-100 manufactured by Nippon Soda Co., Ltd.) | 6.0 parts |
| 10% Aqueous solution of poly(vinyl alcohol) | 5.0 parts |
| Water | 1.5 parts |

[chemical formula 5]

(a)

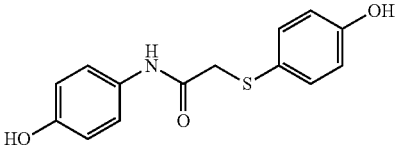

(b)

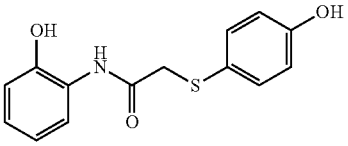

| Solution A-9 (color development agent dispersion) | |
|---|---|
| N-(4'-hydroxyphenylthio) acetyl-2-hydroxyaniline (D-102* manufactured by Nippon Soda Co., Ltd.) | 6.0 parts |
| 10% Aqueous solution of poly(vinyl alcohol) | 5.0 parts |
| Water | 1.5 parts |

*D-102 is represented by the formula 12 below:

[chemical formula 12]

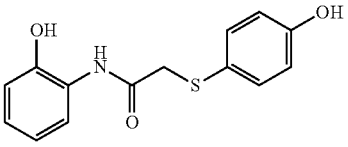

| Solution A-10 (color development agent dispersion) | |
|---|---|
| Bisphenol A (BPA* manufactured by Mitsui Chemical, Inc.) | 6.0 parts |
| 10% Aqueous solution of poly(vinyl alcohol) | 5.0 parts |
| Water | 1.5 parts |

*BPA is represented by the following formula 13 below:

[chemical formula 13]

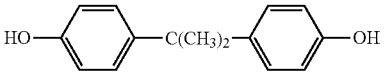

| Solution A-11 (color development agent dispersion) | |
|---|---|
| BisP-AP (Bisphenol AP* manufactured by Honshu Chemical Industry Co. Ltd.) | 6.0 parts |
| 10% Aqueous solution of poly(vinyl alcohol) | 5.0 parts |
| Water | 1.5 parts |

*Bisphenol AP is represented by the formula 14 below.

[chemical formula 14]

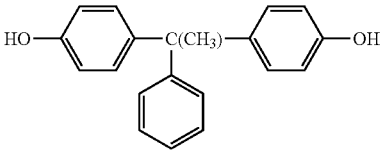

| Solution B (color development agent dispersion) | |
|---|---|
| 1-[4-(4-Hydroxyphenyl sulfonyl) phenoxy]-4-[4-(4-isopropoxyphenylsulfonyl)phenoxy] butane (a compound represented by the formula 15 below synthesized as described in Japanese Patent Application Public Disclosure No. 2003-212841) | 6.0 parts |
| 10% Aqueous solution of poly(vinyl alcohol) | 5.0 parts |
| Water | 1.5 parts |

[chemical formula 15]

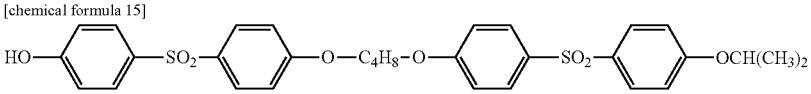

| Solution C (basic colorless dye dispersion) | |
|---|---|
| 3-Dibutylamino-6-methyl-7-anilinofluorane (ODB-2 manufactured by Yamamoto Kasei K.K.) | 6.0 parts |
| 10% Aqueous solution of poly(vinyl alcohol) | 5.0 parts |
| Water | 1.5 parts |

| Solution D-1 (sensitizer dispersion) | |
|---|---|
| 1,2-bis(phenoxymethyl) benzene (PMB-2 manufactured by Nicca Chemical Co., Ltd.) | 6.0 parts |
| 10% Aqueous solution of poly(vinyl alcohol) | 5.0 parts |
| Water | 1.5 parts |

| Solution D-2 (sensitizer dispersion) | |
|---|---|
| Benzyloxy naphthalene (manufactured by Ueno Fine Chemical Industry, Ltd.) | 6.0 parts |
| 10% Aqueous solution of poly(vinyl alcohol) | 5.0 parts |
| Water | 1.5 parts |

| Solution D-3 (sensitizer dispersion) | |
|---|---|
| 1,2-di-(3-Methylphenoxy) ethane (KS232 manufactured by Sanko Co., Ltd.) | 6.0 parts |
| 10% Aqueous solution of poly(vinyl alcohol) | 5.0 parts |
| Water | 1.5 parts |

| Solution D-4 (sensitizer dispersion) | |
|---|---|
| bis-paramethylbenzyl oxalate (HS3520 manufactured by DIC Corporation) | 6.0 parts |
| 10% Aqueous solution of poly(vinyl alcohol) | 5.0 parts |
| Water | 1.5 parts |

Next individual dispersions were blended in the proportions described below to prepare thermosensitive color developing layer coating solution 1.

| | |
|---|---|
| A-1 solution (the first color developing agent dispersion) | 18.0 parts |
| Solution B (the second color developing agent dispersion) | 18.0 parts |

-continued

| | |
|---|---|
| Solution C (basic colorless dye dispersion) | 18.0 parts |
| D-1 solution (sensitizer dispersion) | 36.0 parts |
| Silica (P537, 25% dispersion, manufactured by Mizusawa Industrial Chemicals, Ltd.) | 17.5 parts |
| Poly(vinyl alcohol) (10% solution) | 25.0 parts |

Next individual dispersions were blended in the proportions described below to prepare thermosensitive color developing layer coating solution 2.

| | |
|---|---|
| A-4 solution (the first color developing agent dispersion) | 36.0 parts |
| Solution B (the second color developing agent dispersion) | 36.0 parts |
| Solution C (basic colorless dye dispersion) | 18.0 parts |
| D-1 solution (sensitizer dispersion) | 36.0 parts |
| Silica (P537, 25% dispersion, manufactured by Mizusawa Industrial Chemicals, Ltd.) | 17.5 parts |
| Poly(vinyl alcohol) (10% solution) | 25.0 parts |

Next individual dispersions were blended in the proportions described below to prepare thermosensitive color developing layer coating solution 3.

| | |
|---|---|
| A-3 solution (the first color developing agent dispersion) | 36.0 parts |
| Solution B (the second color developing agent dispersion) | 36.0 parts |
| Solution C (basic colorless dye dispersion) | 18.0 parts |
| D-1 solution (sensitizer dispersion) | 36.0 parts |
| Silica (P537, 25% dispersion, manufactured by Mizusawa Industrial Chemicals, Ltd.) | 17.5 parts |
| Poly(vinyl alcohol) (10% solution) | 25.0 parts |

Next individual dispersions were blended in the proportions described below to prepare thermosensitive color developing layer coating solution 4.

| | |
|---|---|
| A-7 solution (the first color developing agent dispersion) | 36.0 parts |
| Solution B (the second color developing agent dispersion) | 36.0 parts |
| Solution C (basic colorless dye dispersion) | 36.0 parts |
| D-3 solution (sensitizer dispersion) | 36.0 parts |
| Silica (P537, 25% dispersion, manufactured by Mizusawa Industrial Chemicals, Ltd.) | 17.5 parts |
| Poly(vinyl alcohol) (10% solution) | 25.0 parts |

Next individual dispersions were blended in the proportions described below to prepare thermosensitive color developing layer coating solution 5.

| | |
|---|---|
| A-9 solution (the first color developing agent dispersion) | 36.0 parts |
| Solution B (the second color developing agent dispersion) | 36.0 parts |
| Solution C (basic colorless dye dispersion) | 36.0 parts |
| D-4 solution (sensitizer dispersion) | 36.0 parts |
| Silica (P537, 25% dispersion, manufactured by Mizusawa Industrial Chemicals, Ltd.) | 17.5 parts |
| Poly(vinyl alcohol) (10% solution) | 25.0 parts |

Next individual dispersions were blended in the proportions described below to prepare thermosensitive color developing layer coating solution 6.

| | |
|---|---|
| A-10 solution (the first color developing agent dispersion) | 54.0 parts |
| Solution B (the second color developing agent dispersion) | 18.0 parts |
| Solution C (basic colorless dye dispersion) | 18.0 parts |
| D-2 solution (sensitizer dispersion) | 36.0 parts |
| Silica (P537, 25% dispersion, manufactured by Mizusawa Industrial Chemicals, Ltd.) | 17.5 parts |
| Poly(vinyl alcohol) (10% solution) | 25.0 parts |

| Protective layer coating solution | |
|---|---|
| 50% Aluminum hydroxide dispersion (Martifin OL manufactured by Martinswerg) | 9.0 parts |
| Carboxyl modified poly(vinyl alcohol) (KL318 manufactured by Kuraray Co., Ltd. degree of polymerization about 1,700, degree of saponification 95 mole % to 99 mole %) 10% aqueous solution | 30.0 parts |
| Polyamide epichlorohydrin resin (WS4030 manufactured by Seiko PMC Corporation, solid fraction 25%, degree of cationization 2.7, molecular weight 2,200,000, a quaternary amine) | 4.0 parts |
| Modified polyamine resin (Sumirez Resin SPI-102A manufactured by Sumitomo Chemical Co., Ltd. solid fraction 45%) | 2.2 parts |
| Zinc stearate (HydrinZ-7-30 manufactured by Chukyo Yushi Co., Ltd. solid fraction 30%) | 2.0 parts |

A mixture comprising the composition described above was blended and agitated to prepare a protective layer coating solution.

Example 1

An undercoating layer coating solution was applied to one side of a free paper (47 g/m$^2$ substrate) using a Mayer bar at a coating rate of 10.0 g/m$^2$ and was dried (for 2 minutes using a forced air dryer at 60° C.) to prepare an undercoated paper. A thermosensitive recording medium was obtained by applying a thermosensitive color developing layer coating solution 1 on the undercoating layer of the undercoated paper at a coating rate of 6.0 g/m$^2$ and drying (for 2 minutes using a forced air dryer at 60° C.). The sheet was super calendared to a degree of smoothness of 500 to 1,000 seconds to yield a thermosensitive recording medium.

Example 2

A thermosensitive recording medium was prepared in the same manner described in Example 1 with the exception that the amount of A-1 solution used was changed to 27 parts and the amount of solution B used was changed to 9 parts.

Example 3

A thermosensitive recording medium was prepared in the same manner described in Example 1 with the exception that the amount of A-1 solution used was changed to 30 parts and the amount of solution B used was changed to 6 parts.

Example 4

A thermosensitive recording medium was prepared in the same manner described in Example 1 with the exception that the amount of A-1 solution used was changed to 9 parts and the amount of solution B used was changed to 27 parts.

Example 5

A thermosensitive recording medium was prepared in the same manner described in Example 1 with the exception that the amount of A-1 solution used was changed to 6 parts and the amount of solution B used was changed to 30 parts.

Example 6

A thermosensitive recording medium was prepared in the same manner described in Example 1 with the exception that the amount of A-1 solution used was changed to 36 parts, the amount of solution B used was changed to 36 parts and D-1 solution was changed to D-2 solution.

Example 7

A thermosensitive recording medium was prepared in the same manner described in Example 6 with the exception that the amount of A-1 solution used was changed to 54 parts and the amount of solution B used was changed to 18 parts.

Example 8

A thermosensitive recording medium was prepared in the same manner described in Example 7 with the exception that D-1 solution was changed to D-3 solution.

Example 9

A thermosensitive recording medium was prepared in the same manner described in Example 7 with the exception that D-1 solution was changed to D-4 solution.

Example 10

A thermosensitive recording medium was prepared in the same manner described in Example 6 with the exception that the amount of A-1 solution used was changed to 64 parts and the amount of solution B used was changed to 8 parts.

Example 11

The amount of silica added to the thermosensitive color developing layer coating solution in the procedure described in Example 1 was changed to 7.5 parts, and a thermosensitive recording medium was prepared. A protective layer coating solution was applied at a coating rate of 3 g/m$^2$ and was dried (for 2 minutes using a forced air dryer at 60° C.) to prepare a thermosensitive recording medium.

Example 12

The amount of silica added to the thermosensitive color developing layer coating solution in the procedure described in Example 2 was changed to 7.5 parts, and a thermosensitive recording medium was prepared. A protective layer coating solution was applied at a coating rate of 3 g/m$^2$ and was dried (for 2 minutes using a forced air dryer at 60° C.) to prepare a thermosensitive recording medium.

Example 13

The amount of silica added to the thermosensitive color developing layer coating solution in the procedure described in Example 3 was changed to 7.5 parts, and a thermosensitive recording medium was prepared. A protective layer coating solution was applied at a coating rate of 3 g/m$^2$ and was dried (for 2 minutes using a forced air dryer at 60° C.) to prepare a thermosensitive recording medium.

Comparative Example 1

A thermosensitive recording medium was prepared in the same manner described in Example 1 with the exception of using 36 parts of A-1 solution and no solution B.

Comparative Example 2

A thermosensitive recording medium was prepared in the same manner described in Example 1 with the exception of using 36 parts of solution B and no A-1 solution.

Comparative Example 3

A thermosensitive recording medium was prepared in the same manner described in Example 6 with the exception of changing solution A-1 to solution A-2.

Comparative Example 4

A thermosensitive recording medium was prepared in the same manner described in Example 7 with the exception of changing solution A-1 to solution A-2.

Comparative Example 5

A thermosensitive recording medium was prepared in the same manner described in Example 7 with the exception of changing solution B to solution A-2.

Comparative Example 6

A thermosensitive recording medium was prepared in the same manner described in Example 1 with the exception of changing solution B to solution A-3.

Comparative Example 7

The amount of silica added to the thermosensitive color developing layer coating solution in the procedure described in Comparative Example 1 was changed to 7.5 parts, and a thermosensitive recording medium was prepared. A protective layer coating solution was applied at a coating rate of 3 g/m$^2$ and was dried (for 2 minutes using a forced air dryer at 60° C.) to prepare a thermosensitive recording medium.

Example 14

An undercoating layer coating solution was applied to one side of a free paper (47 g/m$^2$ substrate) using a Mayer bar at a coating rate of 10.0 g/m$^2$ and was dried (for 2 minutes using a forced air dryer at 60° C.) to prepare an undercoated paper. A thermosensitive recording medium was obtained by applying a thermosensitive color developing layer coating solution 2 on the undercoating layer of the undercoated paper at a coating rate of 6.0 g/m$^2$ and drying (for 2 minutes using a forced air dryer at 60° C.). The sheet was super calendared to a degree of smoothness of 500 to 1,000 seconds to yield a thermosensitive recording medium.

Example 15

The amount of silica in the procedure described in Example 14 was changed to 7.5 parts, and a thermosensitive recording medium was prepared. A protective layer coating solution was applied at a coating rate of 3 g/m$^2$ and was dried (for 2 minutes using a forced air dryer at 60° C.) to prepare a thermosensitive recording medium.

Example 16

A thermosensitive recording medium was prepared in the same manner described in Example 14 with the exception of using 18 parts of A-4 and 54 parts of solution B in the thermosensitive color developing coating solution.

Example 17

A thermosensitive recording medium was prepared in the same manner described in Example 14 with the exception of using 54 parts of A-4 and 18 parts of solution B in the thermosensitive color developing coating solution.

Example 18

A thermosensitive recording medium was prepared in the same manner described in Example 17 with the exception of changing solution D-1 to solution D-2.

Comparative Example 8

A thermosensitive recording medium was prepared in the same manner described in Example 14 with the exception of using 72 parts of A-4 and no solution B in the thermosensitive color developing coating solution.

Comparative Example 9

A thermosensitive recording medium was prepared in the same manner described in Example 14 upon changing solution B to solution A-5 in the thermosensitive color developing coating solution.

Comparative Example 10

A thermosensitive recording medium was prepared in the same manner described in Example 14 upon changing solution B to solution A-2 in the thermosensitive color developing coating solution.

Comparative Example 11

A thermosensitive recording medium was prepared in the same manner described in Comparative Example 10 upon changing the amount of solution A-4 used to 18 parts and the amount of solution B used to 54 parts.

Example 19

An undercoating layer coating solution was applied to one side of a free paper (47 g/m$^2$ substrate) using a Mayer bar at a coating rate of 10.0 g/m$^2$ and was dried (for 2 minutes using a forced air dryer at 60° C.) to prepare an undercoated paper. A thermosensitive recording medium was obtained by applying a thermosensitive color developing layer coating solution 3 on the undercoating layer of the undercoated paper at a coating rate of 6.0 g/m$^2$ and drying (for 2 minutes using a forced air dryer at 60° C.). The sheet was super calendared to a degree of smoothness of 500 to 1,000 seconds to yield a thermosensitive recording medium.

Example 20

A thermosensitive recording medium was prepared using the same procedure described in Example 19 with the exception of changing the solution A-3 in the color developing layer coating solution to the solution A-5.

Example 21

A thermosensitive recording medium was prepared using the same procedure described in Example 19 with the exception of changing the solution A-3 in the color developing layer coating solution to the solution A-6.

Example 22

A thermosensitive recording medium was prepared using the same procedure described in Example 21 with the exception of changing the amount of solution A-6 used to 54 parts and the amount of solution B to 18 parts.

Example 23

A thermosensitive recording medium was prepared using the same procedure described in Example 21 with the exception of changing the amount of solution A-6 used to 18 parts and the amount of solution B to 54 parts.

Example 24

The amount of silica in the procedure described in Example 19 was changed to 7.5 parts, and a thermosensitive recording medium was prepared. A protective layer coating solution was applied at a coating rate of 3 g/m$^2$ and was dried (for 2 minutes using a forced air dryer at 60° C.) to prepare a thermosensitive recording medium.

Example 25

A thermosensitive recording medium was prepared in the same manner described in Example 19 with the exception of changing solution A-3 to solution A-5 and solution D-1 to solution D-2.

Example 26

A thermosensitive recording medium was prepared in the same manner described in Example 25 with the exception of using 54 parts of A-5 and 18 parts of solution B in the thermosensitive color developing coating solution.

Example 27

A thermosensitive recording medium was prepared in the same manner described in Example 25 with the exception of using 64 parts of A-5 and 8 parts of solution B in the thermosensitive color developing coating solution.

Example 28

A thermosensitive recording medium was prepared in the same manner described in Example 26 with the exception of changing solution D-2 to solution D-3.

Example 29

A thermosensitive recording medium was prepared in the same manner described in Example 26 with the exception of changing solution D-2 to solution D-4.

Example 30

A thermosensitive recording medium was prepared in the same manner described in Example 26 with the exception of changing solution A-5 to solution A-6.

Example 31

A thermosensitive recording medium was prepared in the same manner described in Example 26 with the exception of changing solution A-5 to solution A-3.

Comparative Example 12

A thermosensitive recording medium was prepared in the same manner described in Example 19 with the exception of using 72 parts of A-3 and no solution B in the thermosensitive color developing coating solution.

Comparative Example 13

A thermosensitive recording medium was prepared in the same manner described in Example 19 upon changing solution B to solution A-5 in the thermosensitive color developing coating solution.

Comparative Example 14

A thermosensitive recording medium was prepared in the same manner described in Example 19 upon changing solution B to solution A-2 in the thermosensitive color developing coating solution.

Comparative Example 15

A thermosensitive recording medium was prepared in the same manner described in Comparative Example 14 upon changing the amount of solution A-3 used to 18 parts and the amount of solution A-2 used to 54 parts.

Example 32

An undercoating layer coating solution was applied to one side of a free paper (47 g/m$^2$ substrate) using a Mayer bar at a coating rate of 10.0 g/m$^2$ and was dried (for 2 minutes using a forced air dryer at 60° C.) to prepare an undercoated paper. A thermosensitive recording medium was obtained by applying a thermosensitive color developing layer coating solution 4 on the undercoating layer of the undercoated paper at a coating rate of 6.0 g/m$^2$ and drying (for 2 minutes using a forced air dryer at 60° C.). The sheet was super calendared to a degree of smoothness of 500 to 1,000 seconds to yield a thermosensitive recording medium.

Example 33

A thermosensitive recording medium was prepared in the same manner described in Example 32 upon changing solution A-7 to 54 parts and solution B to 18 parts in the thermosensitive color developing coating solution.

Example 34

A thermosensitive recording medium was prepared in the same manner described in Example 32 with the exception of changing solution A-7 to 18 parts and solution B to 54 parts in the thermosensitive color developing coating solution.

Example 35

A thermosensitive recording medium was prepared in the same manner described in Example 32 with the exception of changing the solution D-3 used to solution D-2.

Example 36

A thermosensitive recording medium was prepared in the same manner described in Example 33 with the exception of changing the solution D-3 used to solution D-2.

Example 37

The amount of silica added to the thermosensitive color developing layer coating solution 4 in the procedure described in Example 32 was changed to 7.5 parts, and a thermosensitive recording medium was prepared. A protective layer coating solution was applied at a coating rate of 3 g/m$^2$ and was dried (for 2 minutes using a forced air dryer at 60° C.) to prepare a thermosensitive recording medium.

Comparative Example 16

A thermosensitive recording medium was prepared in the same manner described in Example 32 with the exception of using 72 parts of solution B and no solution A-7.

Comparative Example 17

A thermosensitive recording medium was prepared in the same manner described in Example 32 with the exception of using 72 parts of A-7 and no solution B in the thermosensitive color developing coating solution.

Comparative Example 18

The amount of silica added to the thermosensitive color developing layer coating solution in the procedure described in Comparative Example 17 was changed to 7.5 parts, and a thermosensitive recording medium was prepared. A protective layer coating solution was applied at a coating rate of 3 g/m$^2$ and was dried (for 2 minutes using a forced air dryer at 60° C.) to prepare a thermosensitive recording medium.

Example 38

An undercoating layer coating solution was applied to one side of a free paper (47 g/m$^2$ substrate) using a Mayer bar at a coating rate of 10.0 g/m$^2$ and was dried (for 2 minutes using a forced air dryer at 60° C.) to prepare an undercoated paper. A thermosensitive recording medium was obtained by applying a thermosensitive color developing layer coating solution 5 on the undercoating layer of the undercoated paper at a coating rate of 6.0 g/m$^2$ and drying (for 2 minutes using a forced air dryer at 60° C.). The sheet was super calendared to a degree of smoothness of 500 to 1,000 seconds to yield a thermosensitive recording medium.

Example 39

A thermosensitive recording medium was prepared in the same manner described in Example 38 with the exception of changing the solution D-4 used to solution D-3.

Example 40

A thermosensitive recording medium was prepared in the same manner described in Example 38 with the exception of changing the solution A-9 to 27 parts and solution B to 9 parts and changing solution D-4 used to solution D-2 in the thermosensitive color developing layer coating solution.

Example 41

A thermosensitive recording medium was prepared in the same manner described in. Example 38 with the exception of changing the solution D-4 used in the thermosensitive color developing layer coating solution to solution D-2.

Example 42

A thermosensitive recording medium was prepared in the same manner described in Example 38 with the exception of changing the solution D-4 used in the thermosensitive color developing layer coating solution to solution D-1.

Example 43

A thermosensitive recording medium was prepared in the same manner described in Example 38 with the exception of changing the dye in solution C (a dye dispersion) to 3-N-di-n-pentylamino-6-methyl-7-anilinofluorane (BLACK 305 manufactured by Yamada Chemical Co., Ltd.).

Example 44

A thermosensitive recording medium was prepared in the same manner described in Example 38 with the exception of changing the solution A-9 used in the thermosensitive color developing layer coating solution to solution A-8.

Example 45

A thermosensitive recording medium was prepared in the same manner described in Example 41 with the exception of changing the solution A-9 used in the thermosensitive color developing layer coating solution to solution A-8.

Example 46

A thermosensitive recording medium was prepared in the same manner described in Example 40 with the exception of changing the solution A-9 used in the thermosensitive color developing layer coating solution to solution A-8.

Example 47

The amount of silica in the procedure described in Example 38 was changed to 7.5 parts, and a thermosensitive recording medium was prepared. A protective layer coating solution was applied at a coating rate of 3 g/m$^2$ and was dried (for 2 minutes using a forced air dryer at 60° C.) to prepare a thermosensitive recording medium.

Example 48

A thermosensitive recording medium was prepared in the same manner described in Example 47 with the exception of changing the solution A-9 used in the thermosensitive color developing layer coating solution to solution A-8.

Example 49

A thermosensitive recording medium was prepared in the same manner described in Example 47 with the exception of changing the amount of solution A-9 to 24 parts and solution B to 12 parts in the thermosensitive color developing layer coating solution.

Example 50

A thermosensitive recording medium was prepared in the same manner described in Example 47 with the exception of changing the amount of solution A-9 to 12 parts and solution B to 24 parts in the thermosensitive color developing layer coating solution.

Comparative Example 19

A thermosensitive recording medium was prepared in the same manner described in Example 38 with the exception of changing the amount of solution B to 36 parts and using no solution A-9 in the thermosensitive color developing layer coating solution.

Comparative Example 20

A thermosensitive recording medium was prepared in the same manner described in Example 38 with the exception of changing the amount of solution A-9 to 36 parts and using no solution B in the thermosensitive color developing layer coating solution.

Comparative Example 21

A thermosensitive recording medium was prepared in the same manner described in Example 38 with the exception of changing the solution B used in the thermosensitive color developing layer coating solution to solution A-3.

Comparative Example 22

A thermosensitive recording medium was prepared by using 7.5 parts of silica in the thermosensitive color developing layer coating solution of Comparative Example 21. A protective layer coating solution was applied at a coating rate of 3 g/m$^2$ and dried (for 2 minutes using a forced sir dryer at 60° C.) to prepare a thermosensitive recording medium.

Example 51

An undercoating layer coating solution was applied to one side of a free paper (47 g/m$^2$ substrate) using a Mayer bar at a coating rate of 10.0 g/m$^2$ and was dried (for 2 minutes using a forced air dryer at 60° C.) to prepare an undercoated paper. A thermosensitive recording medium was obtained by applying a thermosensitive color developing layer coating solution 6 on the undercoating layer of the undercoated paper at a coating rate of 6.0 g/m$^2$ and drying (for 2 minutes using a forced air dryer at 60° C.). The sheet was super calendared to a degree of smoothness of 500 to 1,000 seconds to yield a thermosensitive recording medium.

Example 52

A thermosensitive recording medium was prepared in the same manner described in Example 51 with the exception of changing the amount of solution A-10 to 64 parts and the amount of solution B to 8 parts in the thermosensitive color developing layer coating solution.

Example 53

A thermosensitive recording medium was prepared in the same manner described in Example 51 with the exception of changing the solution A-10 used in the thermosensitive color developing layer coating solution to solution A-11.

Comparative Example 23

A thermosensitive recording medium was prepared in the same manner described in Example 51 with the exception of changing the amount of solution B to 36 parts and using no solution A-10 in the thermosensitive color developing layer coating solution.

Comparative Example 24

A thermosensitive recording medium was prepared in the same manner described in Example 51 with the exception of changing the amount of solution B to 72 parts and using no solution A-10 in the thermosensitive color developing layer coating solution.

Comparative Example 25

A thermosensitive recording medium was prepared in the same manner described in Example 51 with the exception of changing the amount of solution A-10 to 72 parts and using no solution B in the thermosensitive color developing layer coating solution.

Comparative Example 26

A thermosensitive recording medium was prepared in the same manner described in Example 53 with the exception of changing the amount of solution A-11 to 72 parts and using no solution B in the thermosensitive color developing layer coating solution.

The thermosensitive recording media obtained in the examples and comparative examples above were subjected to the following evaluations.

<Color Development Sensitivity (Printing Intensity)>

A thermosensitive recording medium printer TH-PMD manufactured by Ohkura Engineering Co., Ltd. was used to print checks at an applied energy of 0.35 mJ/dot. The color developed section was examined using a Macbeth Densitometer.

<Plasticizer Resistance 1: Image Remaining Rate 1>

Dia Wrap (manufactured by Mitsubishi Plastics, Inc.) was brought in contact with the front and back of the thermosensitive recording medium printed in the sensitivity test 1 and was left standing for 24 hours in an environment where the temperature was 50° C. and humidity was 90%. The print density (intensity of the printed section) of the color developed section was measured, and the image remaining rate was calculated using the values before and after the test.

Image remaining rate=(print section intensity after testing)/(print section intensity before testing)×100 (%)

Rating:

Excellent: Image remaining rate is at least 90%

Good: Image remaining rate is at least 75% but less than 90%

Fair: Image remaining rate is at least 50% but less than 75%

Poor: Image remaining rate is less than 50%

<Plasticizer Resistance 1: Image Remaining Rate 2>

Dia Wrap (manufactured by Mitsubishi Plastics, Inc.) was brought in contact with the front and back of the thermosensitive recording medium printed in the sensitivity test 1 and was left standing for 24 hours in an environment where the temperature was 40° C. and humidity was 90%. The print density (intensity of the printed section) of the color developed section was measured, and the image remaining rate was calculated using the values before and after the test.

Image remaining rate=(print section intensity after testing)/(print section intensity before testing)×100 (%)

Rating:

Excellent: Image remaining rate is at least 90%

Good: Image remaining rate is at least 75% but less than 90%

Fair: Image remaining rate is at least 50% but less than 75%

Poor: Image remaining rate is less than 50%

<Plasticizer Resistance 1: Bar Code Readability>

The front and back of a thermosensitive recording medium printed with a bar code (CODE39) using a label printer 140XiIII manufactured by Zebra Co., Ltd. was brought in contact with Dia Wrap (manufactured by Mitsubishi Plastics, Inc.) and was left standing for 24 hours in an environment where the temperature was 40° C. and humidity was 90%. A bar code reader (Quick Check PC 600 manufactured by Nihon Systex Ltd.) was used for the evaluation. The evaluation was conducted using the ANSI grades (used ten of measaurements) and the manner described below. Now, a rating C or better result meant that no practical problem was experienced when reading bar codes. Similarly, a rating D or poorer result meant that problems were encountered as far as bar code readability was concerned.

Rating: (Excellent) A>B>C>D>F (Poor)

<Sensitivity 2 (Printing Rntensity)>

A thermosensitive recording medium printer TH-PMD manufactured by Ohkura Engineering Co., Ltd. was used to print checks at applied energy of 0.28 mJ/dot. The color developed section was examined using a Macbeth Densitometer.

<Plasticizer Resistance 2: Image Remaining Rate>

Dia Wrap (manufactured by Mitsubishi Plastics, Inc.) was brought in contact with the front and back of the thermosensitive recording medium printed in the sensitivity test 2 and was left standing for 24 hours in an environment where the temperature was 40° C. and humidity was 90%. The print density (intensity of the printed section) of the color developed section was measured, and the image remaining rate was calculated using the values before and after the test.

Image remaining rate=(print section intensity after testing)/(print section intensity before testing)×100 (%)

Rating:

Excellent: Image remaining rate is at least 90%

Good: Image remaining rate is at least 75% but less than 90%

Fair: Image remaining rate is at least 50% but less than 75%

Poor: Image remaining rate is less than 50%

<Plasticizer Resistance 2: Bar Code Readability>

The front and back of a thermosensitive recording medium printed with a bar code (CODE39) using a label printer 140XiIII manufactured by Zebra Co., Ltd. was brought in contact with Dia Wrap (manufactured by Mitsubishi Plastics, Inc.) and was left standing for 24 hours in an environment where the temperature was 40° C. and humidity was 90%. A bar code reader (Quick Check PC 600 manufactured by Nihon Systex Ltd.) was used for the evaluation.

<Heat Resistance 1>

A blank paper sample was left standing for 24 hours in an environment where the temperature was 80° C. and the color development intensity was measured before and after the test. The background color development value was obtained.

Background color development value=developed color intensity after the test−developed color intensity before the test Rating:

Excellent: Developed background color is less than 0.1

Good: Developed background color is at least 0.1 but less than 0.3

Fair: Developed background color is at least 0.3 but less than 0.5

Poor: Developed background color is at least 0.5

<Heat Resistance 2: Background Color Development>

A blank paper sample was left standing for 24 hours in an environment where the temperature was 90° C. and the color development intensity was measured before and after the test. The background color development value was obtained.

Background color development value=developed color intensity after the test−developed color intensity before the test Rating:

Excellent: Developed background color is less than 0.1

Good: Developed background color is at least 0.1 but less than 0.3

Fair: Developed background color is at least 0.3 but less than 0.5

Poor: Developed background color is at least 0.5

<Plasticizer Resistance 2: Bar Code Readability>

The front and back of a thermosensitive recording medium printed with a bar code (CODE39) using a label printer 140XiIII manufactured by Zebra Co., Ltd. was brought in contact and was left standing for 24 hours in an environment where the temperature was 90° C. A bar code reader (Quick Check I/O 600 manufactured by Nihon Systex Ltd.) was used for the evaluation. The evaluation was conducted using the ANSI grades (used ten of measaurements) and the manner described below. Now, a rating C or better result meant that no practical problem was experienced when reading bar codes. Similarly, a rating D or poorer result meant that problems were encountered as far as bar code readability was concerned.

Rating: (Excellent) A>B>C>D>F (Poor)

<Moist Heat Resistance>

A thermosensitive recording medium printer TH-PMD manufactured by Ohkura Engineering Co., Ltd. was used to print checks at applied energy of 0.35 mJ/dot. The thermosensitive recording medium thus printed was left standing for 72 hours in an environment where the temperature was 50° C.

and humidity was 90%. The print density of the color developed section (printed section intensity) was measured, and the image remaining rate was calculated using the values before and after the test.

Image remaining rate=(print section intensity after testing)/(print section intensity before testing)×100 (%)

Rating:

Excellent: Image remaining rate is at least 90%

Good: Image remaining rate is at least 75% but less than 90%

Fair: Image remaining rate is at least 50% but less than 75%

Poor: Image remaining rate is less than 50%

<Light Resistance 1>

A thermosensitive recording medium printer TH-PMD manufactured by

Ohkura Engineering Co., Ltd. was used to print checks at applied energy of 0.35 mJ/dot. The thermosensitive recording medium thus printed was irradiated with ultraviolet rays for 24 hours using a Xenon Fadometer, and the print density of the color developed section (printed section intensity) was measured. The image remaining rate was calculated from the values before and after the test.

Image remaining rate=(print section intensity after testing)/(print section intensity before testing)×100 (%)

Rating:

Excellent: Image remaining rate is at least 90%

Good: Image remaining rate is at least 75% but less than 90%

Fair: Image remaining rate is at least 50% but less than 75%

Poor: Image remaining rate is less than 50%

<Light resistance 2>

A thermosensitive recording medium printer TH-PMD manufactured by Ohkura Engineering Co., Ltd. was used to print checks at applied energy of 0.35 mJ/dot. The thermosensitive recording medium thus printed was treated for 24 hours at an output of 67 W/m$^2$ using a Xenon Fadometer model Ci3000F manufactured by Atlas Co., Ltd., and the print density of the color developed section (printed section intensity) before and after the treatment was measured to calculate the image remaining rate.

Image remaining rate=(print section intensity after testing)/(print section intensity before testing)×100 (%)

Rating:

Excellent: Image remaining rate is at least 90%

Good: Image remaining rate is at least 75% but less than 90%

Fair: Image remaining rate is at least 50% but less than 75%

Poor: Image remaining rate is less than 50%

The results are shown in the tables below. (in the tables, Ex.: Example, C. Ex.: Comparative Example)

TABLE 1

| Ex. | C. Ex. | First color development agent dispersion A | Second color development agent dispersion B | A/B | Sensitizing agent dispersion | Protective layer coating solution | Sensitivity 1 | Plasticizer resistance 1 Image remaining rate 1 | Plasticizer resistance 1 Bar code | Sensitivity 2 | Plasticizer resistance 2 Image remaining rate | Plasticizer resistance 2 Bar code | Heat resistance 2 Background color | Heat resistance 2 Bar code | Moist heat resistance |
|---|---|---|---|---|---|---|---|---|---|---|---|---|---|---|---|
| 1 | | A-1 | B | 1/1 | D-1 | — | 1.44 | Good | B | 1.25 | Excellent | D | Excellent | B | Excellent |
| 2 | | A-1 | B | 3/1 | D-1 | — | 1.48 | Good | B | 1.39 | Excellent | B | Good | B | Excellent |
| 3 | | A-1 | B | 5/1 | D-1 | — | 1.50 | Fair | C | 1.39 | Good | C | Good | C | Excellent |
| 4 | | A-1 | B | 1/3 | D-1 | — | 1.30 | Excellent | C | 1.12 | Excellent | D | Excellent | C | Excellent |
| 5 | | A-1 | B | 1/5 | D-1 | — | 1.25 | Excellent | C | 0.98 | Excellent | F | Excellent | C | Excellent |
| 6 | | A-1 | B | 1/1 | D-2 | — | 1.45 | Good | C | 1.23 | Excellent | D | Excellent | — | Excellent |
| 7 | | A-1 | B | 3/1 | D-2 | — | 1.48 | Good | B | 1.42 | Excellent | B | Excellent | — | Excellent |
| 8 | | A-1 | B | 3/1 | D-3 | — | 1.51 | Good | B | 1.46 | Excellent | B | Good | — | Excellent |
| 9 | | A-1 | B | 3/1 | D-4 | — | 1.48 | Good | B | 1.42 | Excellent | B | Good | — | Excellent |
| 10 | | A-1 | B | 8/1 | D-2 | — | 1.51 | Fair | C | 1.45 | Good | C | Good | — | Excellent |
| 11 | | A-1 | B | 1/1 | D-1 | present | 1.42 | Good | B | 1.19 | Excellent | B | Excellent | B | Excellent |
| 12 | | A-1 | B | 3/1 | D-1 | present | 1.45 | Good | B | — | — | — | Good | B | — |
| 13 | | A-1 | B | 5/1 | D-1 | present | 1.27 | Excellent | C | — | — | — | Excel lent | C | — |
| | 1 | A-1 | — | | D-1 | — | 1.49 | Poor | F | 1.44 | Poor | F | Fair | C | — |
| | 2 | — | B | | D-1 | — | 1.01 | Excellent | D | 0.88 | Excellent | F | Excellent | D | — |
| | 3 | A-2 | B | 1/1 | D-2 | — | 1.11 | Excellent | F | 0.94 | Excellent | F | Good | — | Excellent |
| | 4 | A-2 | B | 3/1 | D-2 | — | 1.09 | Excellent | F | 1.01 | Excellent | F | Good | — | Excellent |
| | 5 | A-1 | A-2 | 3/1 | D-2 | — | 1.48 | Poor | F | 1.23 | Poor | F | Poor | — | Poor |

TABLE 1-continued

| | | | | | | | | | | | | | | | | |
|---|---|---|---|---|---|---|---|---|---|---|---|---|---|---|---|---|
| | 6 | A-1 | A-3 | 1/1 | D-1 | — | 1.51 | Poor | F | 1.41 | Poor | F | Poor | D | — |
| | 7 | A-1 | — | | D-1 | present | 1.42 | Poor | F | 1.36 | Poor | F | Fair | D | Fair |

| Ex. | C. Ex. | First color development agent dispersion A | Second color development agent dispersion B | A/B | Sensitizing agent dispersion | Protective layer coating solution | Sensitivity 1 | Plasticizer resistance 1: Image remaining rate 2 | Plasticizer resistance 1: Bar code | Sensitivity 2 | Plasticizer resistance 2: Image remaining rate | Plasticizer resistance 2: Bar code | Heat resistance 1 | Heat resistance 2 Background color | Light resistance 1 | Moist heat resistance |
|---|---|---|---|---|---|---|---|---|---|---|---|---|---|---|---|---|
| 14 | | A-4 | B | 1/1 | D-1 | — | 1.44 | Good | B | 1.25 | Excellent | D | Good | Good | Good | Excellent |
| 15 | | A-4 | B | 1/1 | D-1 | present | 1.36 | Excellent | B | 1.21 | Excellent | C | Good | Good | Good | Excellent |
| 16 | | A-4 | B | 1/3 | D-1 | — | 1.25 | Excellent | C | 1.12 | Excellent | D | Excellent | Excellent | Good | Excellent |
| 17 | | A-4 | B | 3/1 | D-1 | — | 1.48 | Good | B | 1.36 | Excellent | B | Good | Good | Good | Excellent |
| 18 | | A-4 | B | 3/1 | D-2 | — | 1.48 | Good | B | 1.38 | Excellent | B | — | Good | — | Excellent |
| | 8 | A-4 | — | | D-1 | — | 1.49 | Fair | C | 1.40 | Fair | D | Fair | Poor | Good | Poor |
| | 9 | A-4 | A-5 | 1/1 | D-1 | — | 1.45 | Fair | C | 1.39 | Fair | D | Fair | Poor | Poor | Poor |
| | 10 | A-4 | A-2 | 1/1 | D-1 | — | 1.44 | Good | B | 1.25 | Poor | F | Fair | Poor | Good | Fair |
| | 11 | A-4 | A-2 | 1/3 | D-1 | — | 1.22 | Good | D | 1.08 | Fair | F | Fair | Poor | Fair | Fair |

TABLE 2

| Ex. | C. Ex. | First color development agent dispersion A | Second color development agent dispersion B | A/B | Sensitizing agent dispersion | Protective layer coating solution | Sensitivity 1 | Plasticizer resistance 1: Image remaining rate 2 | Plasticizer resistance 1: Bar code | Sensitivity 2 | Plasticizer resistance 2: Image remaining rate | Plasticizer resistance 2: Bar code | Heat resistance 1 | Heat resistance 2 Background color | Moist heat resistance |
|---|---|---|---|---|---|---|---|---|---|---|---|---|---|---|---|
| 19 | | A-3 | B | 1/1 | D-1 | — | 1.48 | Good | B | 1.26 | Good | D | Good | Good | Excellent |
| 20 | | A-5 | B | 1/1 | D-1 | — | 1.45 | Good | B | 1.22 | Good | D | Excellent ~Good | Excellent ~ Good | Excellent |
| 21 | | A-6 | B | 1/1 | D-1 | — | 1.48 | Good | B | 1.21 | Good | D | Excellent | Excellent | Excellent |
| 22 | | A-6 | B | 3/1 | D-1 | — | 1.50 | Excellent ~Good | B | 1.35 | Excellent | B | Excellent ~Good | Excellent ~Good | Excellent |
| 23 | | A-6 | B | 1/3 | D-1 | — | 1.36 | Excellent ~Good | B | 1.03 | Excellent | F | Good | Good | Excellent |
| 24 | | A-3 | B | 1/1 | D-1 | present | 1.37 | Excellent | B | — | — | — | Excellent ~Good | — | — |
| 25 | | A-5 | B | 1/1 | D-2 | — | 1.48 | Good | B | 1.20 | Excellent | D | — | Excellent | Excellent |
| 26 | | A-5 | B | 3/1 | D-2 | — | 1.51 | Good | C | 1.36 | Excellent | C | — | Good | Excellent |
| 27 | | A-5 | B | 8/1 | D-2 | — | 1.52 | Fair | C | 1.42 | Excellent | C | — | Good | Excellent |
| 28 | | A-5 | B | 3/1 | D-3 | — | 1.53 | Good | C | 1.41 | Excellent | C | — | Good | Excellent |
| 29 | | A-5 | B | 3/1 | D-4 | — | 1.50 | Good | C | 1.37 | Excellent | C | — | Good | Excellent |
| 30 | | A-6 | B | 3/1 | D-2 | — | 1.50 | Good | C | 1.36 | Excellent | C | — | Good | Excellent |
| 31 | | A-3 | B | 3/1 | D-2 | — | 1.52 | Good | C | 1.38 | Excellent | C | — | Good | Excellent |
| | 12 | A-3 | — | — | D-1 | — | 1.35 | Poor | D | 1.42 | Poor | F | Poor | Poor | Poor |
| | 13 | A-3 | A-5 | 1/1 | D-1 | — | 1.32 | Poor | C | 1.40 | Poor | F | Fair | Poor | Poor |
| | 14 | A-3 | A-2 | 1/1 | D-1 | — | 1.45 | Fair | C | 1.28 | Poor | F | Fair | Poor | Fair |
| | 15 | A-3 | A-2 | 1/3 | D-1 | — | 1.15 | Good | C | 1.11 | Fair | F | Poor | Poor | Fair |

| Ex. | C. Ex. | First color development agent dispersion A | Second color development agent dispersion B | A/B | Sensitizing agent dispersion | Protective layer coating solution | Sensitivity 1 | Plasticizer resistance 1: Image remaining rate 1 | Plasticizer resistance 1: Bar code | Sensitivity 2 | Plasticizer resistance 2: Image remaining rate | Plasticizer resistance 2: Bar code | Heat resistance 2 Background color | Moist heat resistance |
|---|---|---|---|---|---|---|---|---|---|---|---|---|---|---|
| 32 | | A-7 | B | 1/1 | D-3 | — | 1.35 | Good | B | 1.21 | Good | D | Good | Excellent |
| 33 | | A-7 | B | 3/1 | D-3 | — | 1.38 | Good | B | 1.29 | Excellent | C | Good | Excellent |
| 34 | | A-7 | B | 1/3 | D-3 | — | 1.30 | Good | C | 1.09 | Excellent | F | Excellent | Excellent |
| 35 | | A-7 | B | 1/1 | D-2 | — | 1.26 | Excellent | B | 1.19 | Excellent | D | Excellent | Excellent |
| 36 | | A-7 | B | 3/1 | D-2 | — | 1.34 | Good | C | 1.29 | Excellent | C | Good | Excellent |
| 37 | | A-7 | B | 1/1 | D-3 | present | 1.35 | Excellent | B | 1.15 | Excellent | D | Excellent | Excellent |

TABLE 2-continued

| | | | | | | | | | | | | | |
|---|---|---|---|---|---|---|---|---|---|---|---|---|---|
| 16 | — | B | — | D-3 | — | 1.01 | Excellent | F | — | — | — | Fair | — |
| 17 | A-7 | — | — | D-3 | — | 1.39 | Fair | D | 1.31 | Poor | F | Good | Poor |
| 18 | A-7 | — | — | D-3 | present | 1.35 | Fair | C | 1.26 | Poor | F | Good | Poor |

TABLE 3

| Ex. | C. Ex. | First color development agent dispersion A | Second color development agent dispersion B | A/B | Sensitizing agent dispersion | Protective layer coating solution | Sensitivity 1 | Plasticizer resistance 1 Image remaining rate 2 | Plasticizer resistance 1 Bar code | Sensitivity 2 | Plasticizer resistance 2 Image remaining rate | Plasticizer resistance 2 Bar code | Heat resistance 1 | Heat resistance 2 Background color | Light resistance 2 | Moist heat resistance |
|---|---|---|---|---|---|---|---|---|---|---|---|---|---|---|---|---|
| 38 | | A-9 | B | 1/1 | D-4 | — | 1.32 | Good | B | 1.21 | Good | D | Good | Good | Excellent | Excellent |
| 39 | | A-9 | B | 1/1 | D-3 | — | 1.35 | Good | B | 1.22 | Good | D | Good | Good | Excellent | Excellent |
| 40 | | A-9 | B | 3/1 | D-2 | — | 1.38 | Good | B | 1.32 | Good | B | — | Good | — | Excellent |
| 41 | | A-9 | B | 1/1 | D-2 | — | 1.35 | Good | B | 1.21 | Good | D | — | Good | — | Excellent |
| 42 | | A-9 | B | 1/1 | D-1 | — | 1.34 | Good | B | 1.19 | Good | D | — | Good | — | Excellent |
| 43 | | A-9 | B | 1/1 | D-4 | — | 1.33 | Good | B | 1.18 | Good | D | Good | Good | Excellent | Excellent |
| 44 | | A-8 | B | 1/1 | D-4 | — | 1.40 | Good | C | 1.21 | Good | D | Good | Good | Excellent | Excellent |
| 45 | | A-8 | B | 1/1 | D-2 | — | 1.42 | Good | B | 1.19 | Good | D | — | Good | — | Excellent |
| 46 | | A-8 | B | 3/1 | D-2 | — | 1.45 | Good | C | 1.29 | Good | C | — | Good | — | Excellent |
| 47 | | A-9 | B | 1/1 | D-4 | present | 1.31 | Good | B | 1.24 | Excellent | C | Good | Good | Excellent | Excellent |
| 48 | | A-8 | B | 1/1 | D-4 | present | 1.39 | Good | — | — | — | — | Good | — | Excellent | — |
| 49 | | A-9 | B | 2/1 | D-4 | present | 1.39 | Good | C | 1.30 | Good | C | Good | Good | Excellent | Excellent |
| 50 | | A-9 | B | 1/2 | D-4 | present | 1.28 | Good | B | 1.05 | Excellent | F | Good | Good | Excellent | Excellent |
| | 19 | — | B | | D-4 | — | 1.02 | Excellent | — | — | — | — | Excellent | — | Fair | — |
| | 20 | A-9 | — | | D-4 | — | 1.41 | Fair | D | 1.36 | Poor | F | Fair | Poor | Excellent | Poor |
| | 21 | A-9 | A-3 | 1/1 | D-4 | — | 1.44 | Poor | D | 1.37 | Poor | F | Poor | Poor | Good | Poor |
| | 22 | A-9 | A-3 | 1/1 | D-4 | present | 1.35 | Fair | F | 1.35 | Poor | F | Poor | Poor | Excellent | Poor |

| Ex. | C. Ex. | First color development agent dispersion A | Second color development agent dispersion B | A/B | Sensitizing agent dispersion | Protective layer coating solution | Sensitivity 1 | Plasticizer resistance 1 Image remaining rate 2 | Plasticizer resistance 1 Bar code | Sensitivity 2 | Plasticizer resistance 2 Image remaining rate | Plasticizer resistance 2 Bar code | Heat resistance 2 Background color | Moist heat resistance |
|---|---|---|---|---|---|---|---|---|---|---|---|---|---|---|
| 51 | | A-10 | B | 3/1 | D-2 | — | 1.48 | Good | C | 1.34 | Good | C | Good | Excellent |
| 52 | | A-10 | B | 8/1 | D-2 | — | 1.51 | Good | C | 1.35 | Good | D | Good | Excellent |
| 53 | | A-11 | B | 3/1 | D-2 | — | 1.45 | Good | C | 1.31 | Good | C | Good | Excellent |
| | 23 | — | B | | D-2 | — | 0.60 | Excellent | F | 0.51 | Excellent | F | Good~Fair | Excellent |
| | 24 | — | B | | D-2 | — | 0.96 | Excellent | F | 0.66 | Excellent | F | Good~Fair | Excellent |

TABLE 3-continued

| | | | | | | | | | | | | | |
|---|---|---|---|---|---|---|---|---|---|---|---|---|---|
| 25 | A-10 | — | 3/1 | D-2 | — | 1.52 | Poor | F | 1.41 | Poor | F | Poor | Poor |
| 26 | A-11 | — | 3/1 | D-2 | — | 1.45 | Poor | F | 1.38 | Poor | F | Poor | Fair |

A thermosensitive recording medium containing a phenol derivative represented by the chemical formula 1 as the first color developing agent and a diphenyl sulfone derivative represented by the chemical formula 2 as the second color developing agent in the thermosensitive color developing layer was shown to have excellent color developing sensitivity, moist heat resistance, heat resistance, plasticizer resistance and the like.

In addition, good bar code readability and color developing sensitivity were obtained when the concentration of the diphenyl sulfone derivative used as the second color developing agent to the color developing agent in the thermosensitive color developing layer was less than 50 wt. % (particularly when the concentration was 5 wt. % to 45 wt. % in the color developing agent). The effect was pronounced when the applied energy in the printed sample was 0.28 mJ/dot [sensitivity 2 (print density), plasticizer resistance 2]. Furthermore, good bar code readability was obtained when benzyloxy naphthalene (D-2), 1,2-di(3-methylphenoxy) ethane (D-3) and bis-paramethylbenzyl oxalate (D-4) were used in the sensitizer. In contrast, good moist heat resistance could not be obtained when a diphenyl sulfone derivative as the second color developing agent was not present.

What is claimed is:

1. A thermosensitive recording medium having a thermosensitive color developing layer comprising a colorless or pale colored electron donating leuco dye and an electron accepting color developing agent on a substrate, wherein the thermosensitive color developing layer contains, as electron accepting color developing agent(s), (a) a phenol derivative represented by the chemical formula 1:

[chemical formula 1]

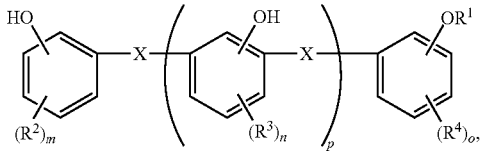

wherein $R^1$ represents a hydrogen atom or a linear or branched, saturated or unsaturated hydrocarbon containing 1 to 4 carbon atoms, $R^2$-$R^4$ independently represent alkyl groups containing 1 to 5 carbon atoms, alkenyl groups containing 1 to 5 carbon atoms, alkoxy groups containing 1 to 5 carbon atoms, aryl groups, aralkyl groups, halogen atoms, hydroxyl groups, cyano groups or nitro groups, X represents —$SO_2$—, —$C(R^5)_2$—, wherein $R^5$ independently represents hydrogen atoms, alkyl groups or aryl groups, or —$NHCOCH_2S$—, m, n and o each represents an integer of 0 to 3, and p represents an integer of 0 to 3, and (b) a diphenyl sulfone derivative represented by the chemical formula 2:

[chemical formula 2]

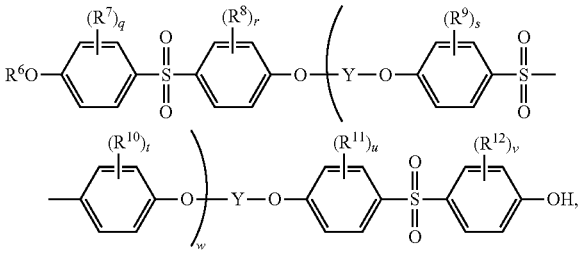

wherein $R^6$ represents a linear or branched, saturated or unsaturated hydrocarbon containing 1 to 12 carbon atoms, $R^7$-$R^{12}$ independently represent halogen atoms, or alkyl or alkenyl groups containing 1 to 12 carbon atoms, q, r, s, t, u and v each represent integers of 0 to 4, w represents an integer of 0 to 5, and Y independently represents a linear or branched, saturated or unsaturated hydrocarbon groups containing 1 to 12 carbon atoms that may contain ether linkages; wherein the ratio for the phenol derivative and the diphenyl sulfone derivative in the thermosensitive color developing layer (phenol derivative:diphenyl sulfone derivative (weight ratio) is 3/1 to 8/1.

2. The thermosensitive recording medium of claim 1, wherein the thermosensitive color developing layer contains as a sensitizer 1,2-di-(3-methylphenoxy) ethane, bis-paramethylbenzyl oxalate or benzyl oxynaphthalene or a combination thereof.

3. The thermosensitive recording medium of claim 1, wherein $R^2$-$R^4$ are independently alkyl groups containing 1 to 5 carbon atoms or alkenyl groups containing 1 to 5 carbon atoms.

4. The thermosensitive recording medium of claim 1, wherein the phenol derivative is 2,2-(4-hydroxyphenyl)propane, 4,4'-1-phenylethylidene bisphenol, or a compound of any one of 1) to 6) of chemical formula 4:

[chemical formula 4]

1)

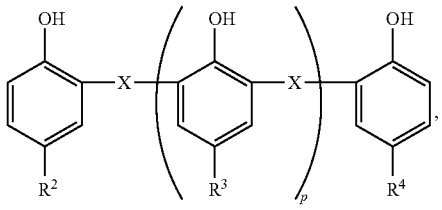

2)

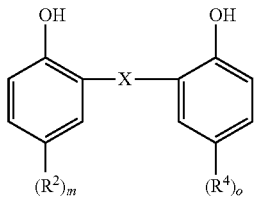

-continued

3)

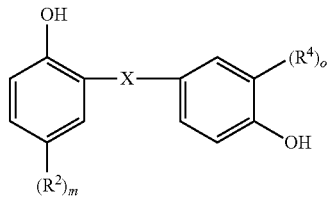

4)

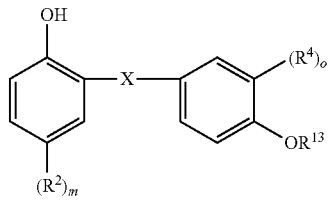

5)

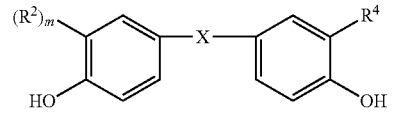

6)

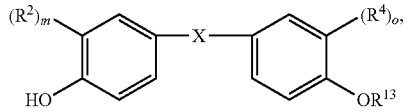

wherein $R^{13}$ represents $R^1$ with the exception of hydrogen atom, and m and o each represents 0 or 1, and other symbols are the same as those described above.

5. The thermosensitive recording medium of claim 1, wherein the phenol derivative is any one of (1) to (2E):

(1) a phenol derivative represented by the chemical formula:

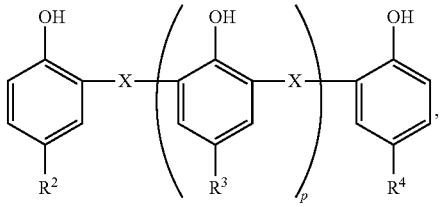

wherein $R^2$, $R^3$ and $R^4$ are independently alkyl groups containing 1 to 5 carbon atoms, X represents —$C(R^5)_2$—, wherein each $R^5$ independently represents a hydrogen atom, an alkyl group containing 1 to 3 carbon atoms or a phenyl group, and p represents an integer of 0 to 3;

(2A) a phenol derivative represented by the chemical formula:

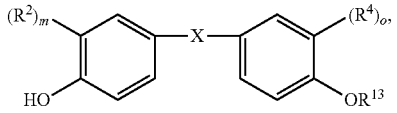

wherein $R^2$ and $R^4$ are independently alkyl groups containing 1 to 5 carbon atoms or alkenyl groups containing 1 to 5 carbon atoms, X represents —$SO_2$—, $R^{13}$ represents a linear or branched, saturated or unsaturated hydrocarbon containing 1 to 4 carbon atoms, and m and o are each independently an integer of 0 or 1;

(2B) N-(4'-hydroxyphenylthio) acetyl-2-hydroxyaniline or N-(4'-hydroxyphenylthio) acetyl-4-hydroxyaniline;

(2C) 2,4'-Dihydroxy diphenyl sulfone;

(2D) bis (3-allyl-4-hydroxyphenyl) sulfone; and (2E) 2,2-(4-hydroxyphenyl) propane or 4,4'-1-phenylethylidene bisphenol.

6. The thermosensitive recording medium of claim 5, wherein the phenol derivative (2A) is 4-hydroxy-4'-isopropoxy diphenyl sulfone, 4-hydroxy-4'-n-propoxy diphenyl sulfone, or 4-hydroxy-4'-allyloxy diphenyl sulfone.

7. The thermosensitive recording medium of claim 5, wherein the phenol derivative (2A) is 4-Hydroxy-4'-allyloxy diphenyl sulfone.

8. The thermosensitive recording medium of claim 5, wherein the phenol derivative (2E) is 4,4'-l-phenyl-ethylidene-bisphenol.

9. The thermosensitive recording medium of claim 1, wherein the phenol derivative has a melting point of 200° C. or lower.

10. A thermosensitive recording medium having a thermosensitive color developing layer comprising a colorless or pale colored electron donating leuco dye and an electron accepting color developing agent on a substrate, wherein the thermosensitive color developing layer contains, as electron accepting color developing agent(s), (a) a phenol derivative represented by the chemical formula:

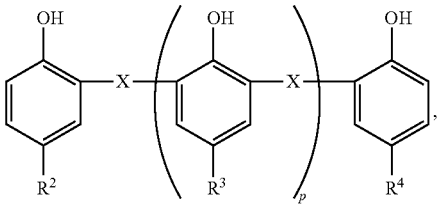

wherein $R^2$, $R^3$ and $R^4$ are independently alkyl groups containing 1 to 5 carbon atoms, X represents —$C(R^5)_2$—, wherein each $R^5$ independently represents a hydrogen atom, an alkyl group containing 1 to 3 carbon atoms or a phenyl group, and p represents an integer of 0 to 3; and (b) a diphenyl sulfone derivative represented by the chemical formula 2:

[chemical formula 2]

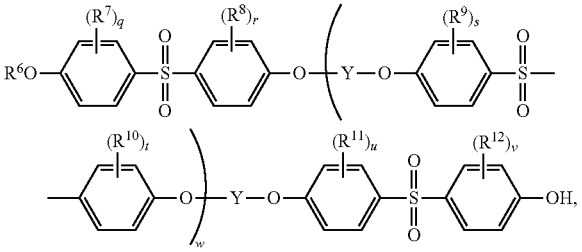

wherein $R^6$ represents a linear or branched, saturated or unsaturated hydrocarbon containing 1 to 12 carbon atoms, $R^7$-$R^{12}$ independently represent halogen atoms, or alkyl or alkenyl groups containing 1 to 12 carbon atoms, q, r, s, t, u and v each represent integers of 0 to 4, w represents an integer of 0 to 5, and Y independently represents a linear or branched, saturated or unsaturated hydrocarbon group containing 1 to 12 carbon atoms that may contain ether linkages;

wherein the ratio for the phenol derivative and the diphenyl sulfone derivative in the thermosensitive color developing layer (phenol derivative:diphenyl sulfone derivative (weight ratio)) is from 95:5 to 55:45, and wherein the phenol derivative is a mixture of condensation products wherein the condensation products contain 40% to 99% of a two ring condensation product where X is —$CH_2$— and p is 0 and the remainder of the condensation products are multi ring condensation products where p is at least 1.

11. A thermosensitive recording medium having a thermosensitive color developing layer comprising a colorless or pale colored electron donating leuco dye and an electron accepting color developing agent on a substrate, wherein the thermosensitive color developing layer contains, as electron accepting color developing agents, (a) a phenol derivative represented by the chemical formula 1:

[chemical formula 1]

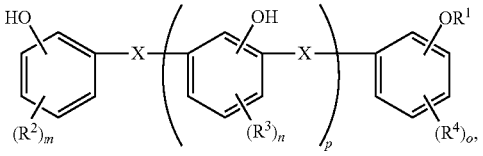

wherein $R^1$ represents a hydrogen atom or a linear or branched, saturated or unsaturated hydrocarbon containing 1 to 4 carbon atoms, $R^2$-$R^4$ independently represent alkyl groups containing 1 to 5 carbon atoms, alkenyl groups containing 1 to 5 carbon atoms, alkoxy groups containing 1 to 5 carbon atoms, aryl groups, aralkyl groups, halogen atoms, hydroxyl groups, cyano groups or nitro groups, X represents —$SO_2$—, —$C(R^5)_2$—, wherein $R^5$ independently represents hydrogen atoms, alkyl groups or aryl groups, or —$NHCOCH_2S$—, m, n and o each represents an integer of 0 to 3, and p represents an integer of 0 to 3, further wherein the phenol derivative is a mixture of condensation products wherein the condensation products contain 40% to 99% of a two ring condensation product where $R^1$ is a hydrogen atom and p is 0 and the remainder of the condensation products are multi-ring condensation products wherein $R^1$ is a hydrogen atom and p is at least 1; and (b) a diphenyl sulfone derivative represented by the chemical formula 2:

[chemical formula 2]

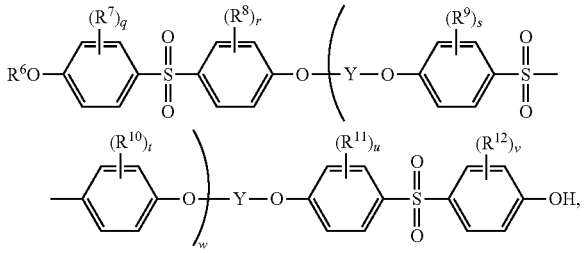

wherein $R^6$ represents a linear or branched, saturated or unsaturated hydrocarbon containing 1 to 12 carbon atoms, $R^7$-$R^{12}$ independently represent halogen atoms, or alkyl or alkenyl groups containing 1 to 12 carbon atoms, q, r, s, t, u and v each represent integers of 0 to 4, w represents an integer of 0 to 5, and Y independently represents a linear or branched, saturated or unsaturated hydrocarbon group containing 1 to 12 carbon atoms that may contain ether linkages.

* * * * *